US010301786B2

(12) United States Patent
Sullivan et al.

(10) Patent No.: US 10,301,786 B2
(45) Date of Patent: May 28, 2019

(54) DEPLOYABLE DEVICE HAVING AN UNROLLED CONFIGURATION FOR RAPID, BI-DIRECTIONAL IMMOBILIZATION OF A TARGETED VEHICLE TRAVELING ON A ROADWAY, AND ASSOCIATED METHODS

(71) Applicant: Pacific Scientific Energetic Materials Company (California) LLC, Valencia, CA (US)

(72) Inventors: Joseph M. Sullivan, Gilbert, AZ (US); Paul D. Wallis, Queen Creek, AZ (US)

(73) Assignee: Pacific Scientific Energetic Materials Company (California) LLC, Hollister, CA (US)

( * ) Notice: Subject to any disclaimer, the term of this patent is extended or adjusted under 35 U.S.C. 154(b) by 0 days.

(21) Appl. No.: 15/001,193

(22) Filed: Jan. 19, 2016

(65) Prior Publication Data

US 2016/0281308 A1 Sep. 29, 2016

Related U.S. Application Data

(63) Continuation-in-part of application No. 14/666,114, filed on Mar. 23, 2015.

(60) Provisional application No. 62/220,958, filed on Sep. 18, 2015.

(51) Int. Cl.
*E01F 13/12* (2006.01)

(52) U.S. Cl.
CPC ..... *E01F 13/12* (2013.01)

(58) Field of Classification Search
CPC ..... E01F 13/12
USPC ..... 404/6
See application file for complete search history.

(56) References Cited

U.S. PATENT DOCUMENTS

| | | | | |
|---|---|---|---|---|
| 1,094,226 A | | 4/1914 | Duc et al. | |
| 2,346,713 A | | 4/1944 | Walker | |
| 3,456,920 A | | 7/1969 | Elvington | |
| 3,652,059 A | * | 3/1972 | Groblebe | E01F 13/12 256/1 |
| 4,145,786 A | | 3/1979 | Myers | |
| 4,544,303 A | | 10/1985 | Glasmire | |

(Continued)

FOREIGN PATENT DOCUMENTS

| | | |
|---|---|---|
| CN | 2261444 Y | 9/1997 |
| CN | 1263253 A | 8/2000 |

(Continued)

OTHER PUBLICATIONS

European Patent Application No. 09819716.3, European Search Report, 6 pages, dated Jan. 22, 2014.

(Continued)

*Primary Examiner* — Thomas B Will
*Assistant Examiner* — Katherine J Chu
(74) *Attorney, Agent, or Firm* — Perkins Coie LLP

(57) ABSTRACT

An apparatus may be positioned at the side of a roadway for ensnaring tires of an oncoming land vehicle. The apparatus comprises a base layer further comprising a plurality of receptacles to hold spikes at both lengthwise edges of the base layer. The base layer is adapted to support a net package in a rolled stowed configuration. The net package includes a set of spikes tethered to netting. A deployment hose is connected to the base layer to cause the base layer to become unrolled for deployment when the deployment hose is inflated.

12 Claims, 30 Drawing Sheets

(56) References Cited

U.S. PATENT DOCUMENTS

| | | | | |
|---|---|---|---|---|
| 4,877,660 | A | 10/1989 | Overbergh et al. | |
| 5,123,774 | A | 6/1992 | Dubiel | |
| 5,322,385 | A | 6/1994 | Reisman | |
| 5,330,285 | A | 7/1994 | Greves et al. | |
| 5,452,962 | A | 9/1995 | Greves | |
| 5,482,397 | A | 1/1996 | Soleau | |
| 5,498,102 | A | 3/1996 | Bissell | |
| 5,503,059 | A | 4/1996 | Pacholok | |
| 5,507,588 | A | 4/1996 | Marts et al. | |
| RE35,373 | E | 11/1996 | Kilgrow et al. | |
| 5,775,832 | A | 7/1998 | Kilgrow et al. | |
| 5,820,293 | A | 10/1998 | Groen et al. | |
| 5,839,849 | A | 11/1998 | Pacholok et al. | |
| 5,871,300 | A | 2/1999 | Ingham | |
| 5,890,832 | A | 4/1999 | Soleau | |
| 5,904,443 | A | 5/1999 | Soleau | |
| 6,048,128 | A * | 4/2000 | Jones | E01F 13/12 256/13.1 |
| 6,155,745 | A | 12/2000 | Groen et al. | |
| 6,206,608 | B1 | 3/2001 | Blevins | |
| 6,220,781 | B1 | 4/2001 | Miller | |
| 6,224,291 | B1 | 5/2001 | Mateychuk | |
| 6,322,285 | B1 * | 11/2001 | Ben | E01F 13/12 404/6 |
| 6,409,420 | B1 | 6/2002 | Horton et al. | |
| 6,474,903 | B1 * | 11/2002 | Marts | E01F 13/123 404/6 |
| 6,527,475 | B1 | 3/2003 | Lowrie | |
| 6,551,013 | B1 | 4/2003 | Blair | |
| 6,623,205 | B1 | 9/2003 | Ramirez | |
| 6,716,234 | B2 | 4/2004 | Grafton et al. | |
| 6,758,628 | B1 | 7/2004 | Curry, Jr. | |
| 6,997,638 | B2 | 2/2006 | Hensley et al. | |
| 7,011,470 | B1 | 3/2006 | Breazeale et al. | |
| 7,025,526 | B2 | 4/2006 | Blair | |
| 7,056,054 | B1 | 6/2006 | Keith et al. | |
| 7,121,760 | B1 | 10/2006 | Curry | |
| 7,201,531 | B2 | 4/2007 | Shackelford et al. | |
| 7,220,076 | B2 | 5/2007 | Boll | |
| 7,226,238 | B2 | 6/2007 | Collier | |
| 7,377,715 | B2 * | 5/2008 | Kruise | E01F 13/12 404/6 |
| 7,441,982 | B1 | 10/2008 | Al-Sabah | |
| 7,524,134 | B2 | 4/2009 | Rastegar et al. | |
| 7,573,379 | B2 | 8/2009 | Moormeier et al. | |
| 7,736,086 | B2 | 6/2010 | Coomber et al. | |
| 7,765,999 | B1 | 8/2010 | Stephens et al. | |
| 7,785,032 | B2 | 8/2010 | Segal | |
| 7,862,251 | B2 | 1/2011 | Lyddon et al. | |
| 7,882,775 | B2 | 2/2011 | Martinez et al. | |
| 7,946,785 | B2 | 5/2011 | Grosch | |
| 7,997,825 | B2 | 8/2011 | Martinez et al. | |
| 8,066,446 | B2 | 11/2011 | Martinez et al. | |
| 8,147,163 | B2 * | 4/2012 | Bare | E01F 13/12 404/6 |
| 8,186,905 | B2 | 5/2012 | Castro et al. | |
| 8,202,019 | B2 * | 6/2012 | Lyddon | E01F 13/12 404/6 |
| 8,231,303 | B1 | 7/2012 | Bowen | |
| 8,469,627 | B2 | 6/2013 | Castro et al. | |
| 8,517,625 | B2 | 8/2013 | McCoy et al. | |
| 8,561,516 | B2 | 10/2013 | Martinez et al. | |
| 8,596,904 | B2 | 12/2013 | Spomer et al. | |
| 8,662,786 | B2 | 3/2014 | Seeglitz et al. | |
| 8,757,039 | B2 | 6/2014 | Martinez et al. | |
| 8,858,113 | B1 | 10/2014 | Mahajan et al. | |
| 8,905,672 | B2 | 12/2014 | Spomer et al. | |
| 8,911,172 | B2 | 12/2014 | Spomer et al. | |
| 9,297,128 | B1 * | 3/2016 | Tang | E01F 13/12 |
| 2005/0214071 | A1 | 9/2005 | Collier | |
| 2005/0244223 | A1 | 11/2005 | Shackelford et al. | |
| 2006/0140715 | A1 | 6/2006 | Lyddon et al. | |
| 2006/0260210 | A1 | 11/2006 | Tanielian et al. | |
| 2007/0264079 | A1 | 11/2007 | Martinez et al. | |
| 2008/0060271 | A1 | 3/2008 | Beniamin et al. | |
| 2008/0124171 | A1 | 5/2008 | Moormeier et al. | |
| 2009/0163095 | A1 | 6/2009 | Weinel et al. | |
| 2009/0263190 | A1 | 10/2009 | Segal | |
| 2010/0086349 | A1 | 4/2010 | Martinez et al. | |
| 2010/0178104 | A1 | 7/2010 | Bare et al. | |
| 2010/0196092 | A1 | 8/2010 | Castro et al. | |
| 2010/0221066 | A1 | 9/2010 | Martinez et al. | |
| 2010/0284739 | A1 | 11/2010 | Allsopp | |
| 2011/0030540 | A1 | 2/2011 | Martinez et al. | |
| 2011/0097147 | A1 | 4/2011 | Castro et al. | |
| 2012/0237293 | A1 | 9/2012 | McCoy et al. | |
| 2014/0119825 | A1 | 5/2014 | Castro et al. | |
| 2014/0199118 | A1 | 7/2014 | Wersching et al. | |
| 2015/0063906 | A1 | 3/2015 | Castro et al. | |
| 2015/0093192 | A1 | 4/2015 | Spomer et al. | |

FOREIGN PATENT DOCUMENTS

| | | | |
|---|---|---|---|
| CN | 2680722 | Y | 2/2005 |
| FR | 2714404 | A | 6/1995 |
| JP | 54-157343 | U | 11/1979 |
| JP | 55-67210 | U | 5/1980 |
| JP | 2008-223380 | A | 3/2007 |
| JP | 31-32994 | U | 4/2007 |
| WO | WO 2005/093163 | A2 | 10/2005 |
| WO | WO 2009/090370 | A1 | 7/2009 |

OTHER PUBLICATIONS

European Patent Application No. EP 10827334.3, Supplementary European Search Report, 5 pages, dated Jun. 11, 2014.
International Application No. PCT/US2009/058892, International Search Report and Written Opinion, 10 pages, dated Nov. 19, 2009.
International Application No. PCT/US2009/059554, International Search Report and Written Opinion, 11 pages, dated Dec. 4, 2009.
International Application No. PCT/US2010/053425, International Search Report and Written Opinion, 11 pages, dated Dec. 13, 2010.
International Application No. PCT/US2010/053428, International Search Report and Written Opinion, 8 pages, dated Dec. 13, 2010.
International Application No. PCT/US2012/054667, International Search Report and Written Opinion, 8 pages, dated Nov. 23, 2012.
International Application No. PCT/US2014/019923, International Search Report & Written Opinion, 11 pages, dated Sep. 4, 2014.
International Application No. PCT/US2014/054149, International Search Report & Written Opinion, 9 pages, dated Dec. 11, 2014.
Japanese Patent Application No. 2011-529376, Office Action, 11 pages, dated Aug. 21, 2013.
Japanese Patent Application No. 2011-531096, Office Action, 6 pages, dated Jul. 30, 2013.
Yates, Travis, "Tire Deflation Devices Help Put an End to Pursuits," PoliceOne.com News, 2 pages, Dec. 20, 2007.
Supplementary Partial European Search Report for European patent application No. 16769483, dated Jan. 16, 2019, European Patent Office, 12 pages.

* cited by examiner

Pressure Test Results

| Test # | Fill Pressure (psi) | Flow Control (# turns) | Deployment Time (s) | Final Pressure (psi) |
|---|---|---|---|---|
| 1 | 1250 | N/A | 4.1 | 80 |
| 2 | 1500 | N/A | 4.6 | 105 |
| **Added Flow Control** | | | | |
| 3 | 2000 | 1 | 4.66 | 90 |
| 4 | 1800 | 1.5 | 3.66 | 100 |
| 5 | 1900 | 1.5 | 3.47 | 110 |
| 6 | 2000 | 1.5 | 3.4 | 135 |
| 7 | 2100 | 1.5 | 3.1 | 125 |

*FIG. 13*

DEPLOYABLE DEVICE HAVING AN UNROLLED CONFIGURATION FOR RAPID, BI-DIRECTIONAL IMMOBILIZATION OF A TARGETED VEHICLE TRAVELING ON A ROADWAY, AND ASSOCIATED METHODS

CROSS-REFERENCE TO RELATED APPLICATION

The present application claims priority to and benefit from U.S. Provisional Patent Application No. 62/220,958 filed on Sep. 18, 2015, and titled "Deployable Device Having An Unrolled Configuration For Rapidly Immobilizing A Land Vehicle And Associated Methods," and is a continuation-in-part of U.S. patent application Ser. No. 14/666,114 filed on Mar. 23, 2015, and titled "Deployable Device Having An Unrolled Configuration For Rapidly Immobilizing A Land Vehicle And Associated Methods," the entire content of each of which is herein expressly incorporated by reference.

TECHNICAL FIELD

The present disclosure relates generally to an apparatus and a method for affecting movement of a land vehicle. More particularly, the present disclosure relates to apparatuses, systems and methods for deterring, slowing, disabling, restraining and/or immobilizing a motor vehicle by entangling one or more tires of the vehicle.

BACKGROUND

Conventional devices for restricting the movement of land vehicles include barriers, tire spike strips, caltrops, snares and electrical system disabling devices. For example, conventional spike strips include spikes projecting upwardly from an elongated base structure that is stored as either a rolled up device or an accordion type device. These conventional spike strips are tossed or thrown on a road in anticipation that an approaching target vehicle will drive over the spike strip. Successfully placing a conventional spike strip in the path of a target vehicle results in one or more tires of the target vehicle being impaled by the spike(s), thereby deflating the tire(s) and making the vehicle difficult to control such that the driver is compelled to slow or halt the vehicle.

Conventional spike strips may be used by first response personnel, law enforcement personnel, armed forces personnel or other security personnel. It is frequently the case that these personnel must remain in close proximity when deploying spike strips. For example, a conventional method of deploying a spike strip is to have the personnel toss the spike strip in the path of an approaching target vehicle.

BRIEF DESCRIPTION OF THE DRAWINGS

FIG. 13 illustrates a summary of results of pressure tests conducted to optimize flow control and rate of pressure for the system kicker and accumulator bottle.

DETAILED DESCRIPTION

Specific details of embodiments according to the present disclosure are described below with reference to devices for deflating tires of an oncoming land vehicle. Other embodiments of the disclosure can have configurations, components, features or procedures different than those described in this section. A person of ordinary skill in the art, therefore, will accordingly understand that the disclosure may have other embodiments with additional elements, or the disclosure may have other embodiments without several of the elements shown and described below with reference to the figures.

General Overview

Figure 1A:
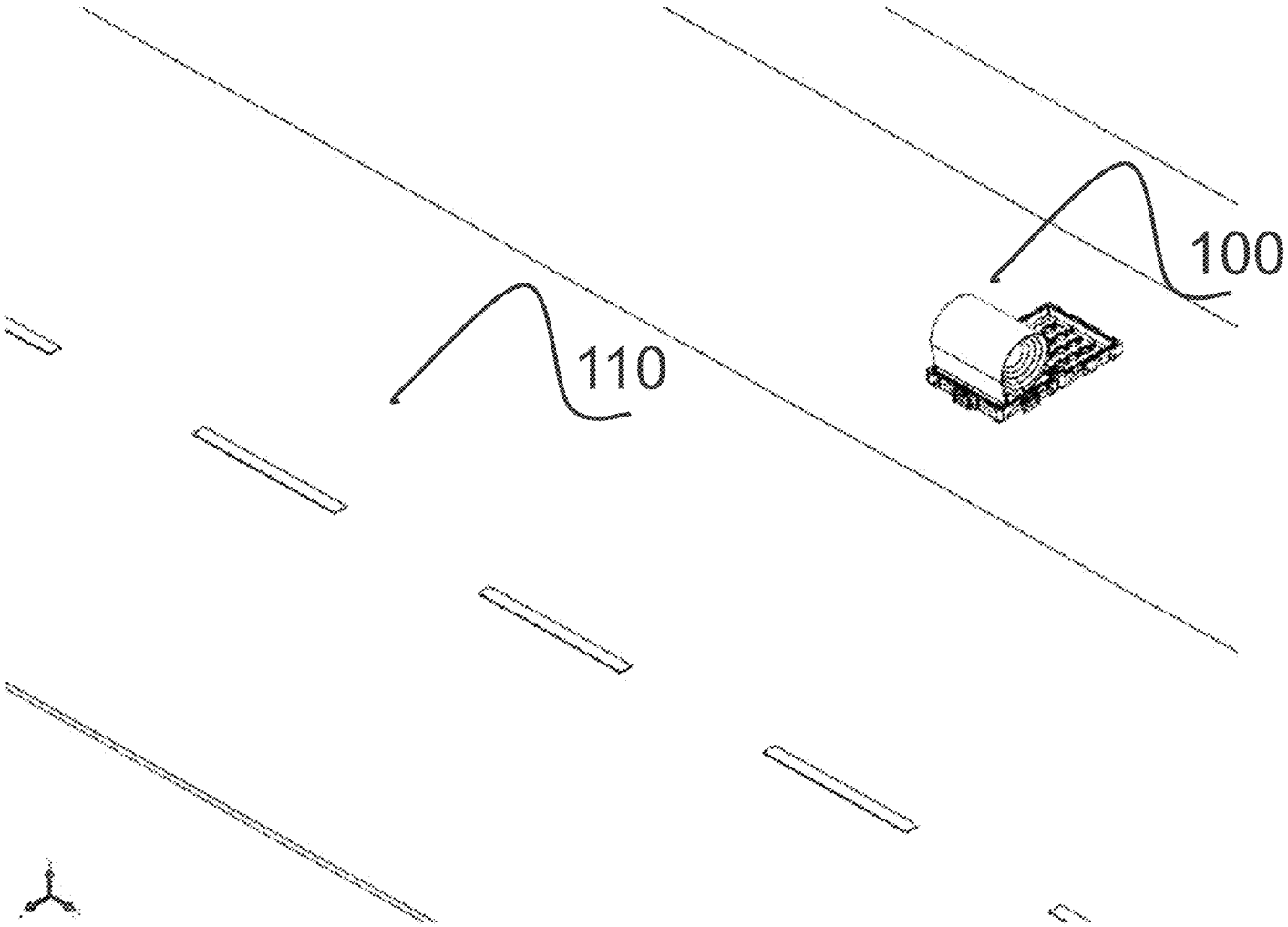
FIG. 1A is a schematic perspective view of an undeployed vehicle immobilizing device positioned on a roadway according to an embodiment of the present disclosure.

FIG. 1A is a schematic perspective view of a device 100, loaded with a netting package and positioned along a roadway 110, in its undeployed state, according to an embodiment of the present disclosure. First response personnel, law enforcement personnel, armed forces personnel or other security personnel may use the device 100 to slow, disable, immobilize and/or restrict the movement of a land vehicle. Examples of land vehicles may include cars, trucks or any other vehicles that use tires to transport the land vehicle. The term "roadway" may refer to natural or man-made terrain including improved roadways, gravel, sand, dirt, or other types of ground. A car traveling on the roadway is supported, steered, and/or accelerated by pneumatic tires relative to the roadway 110. As shown in FIG. 1A, when in its undeployed state, device 100 may be placed on the ground, e.g., on or at the side of the road 110, loaded with a netting package, and then armed. For example, the device 100 can be armed by making a power source available in anticipation of deploying the device 100.

Figure 1B:
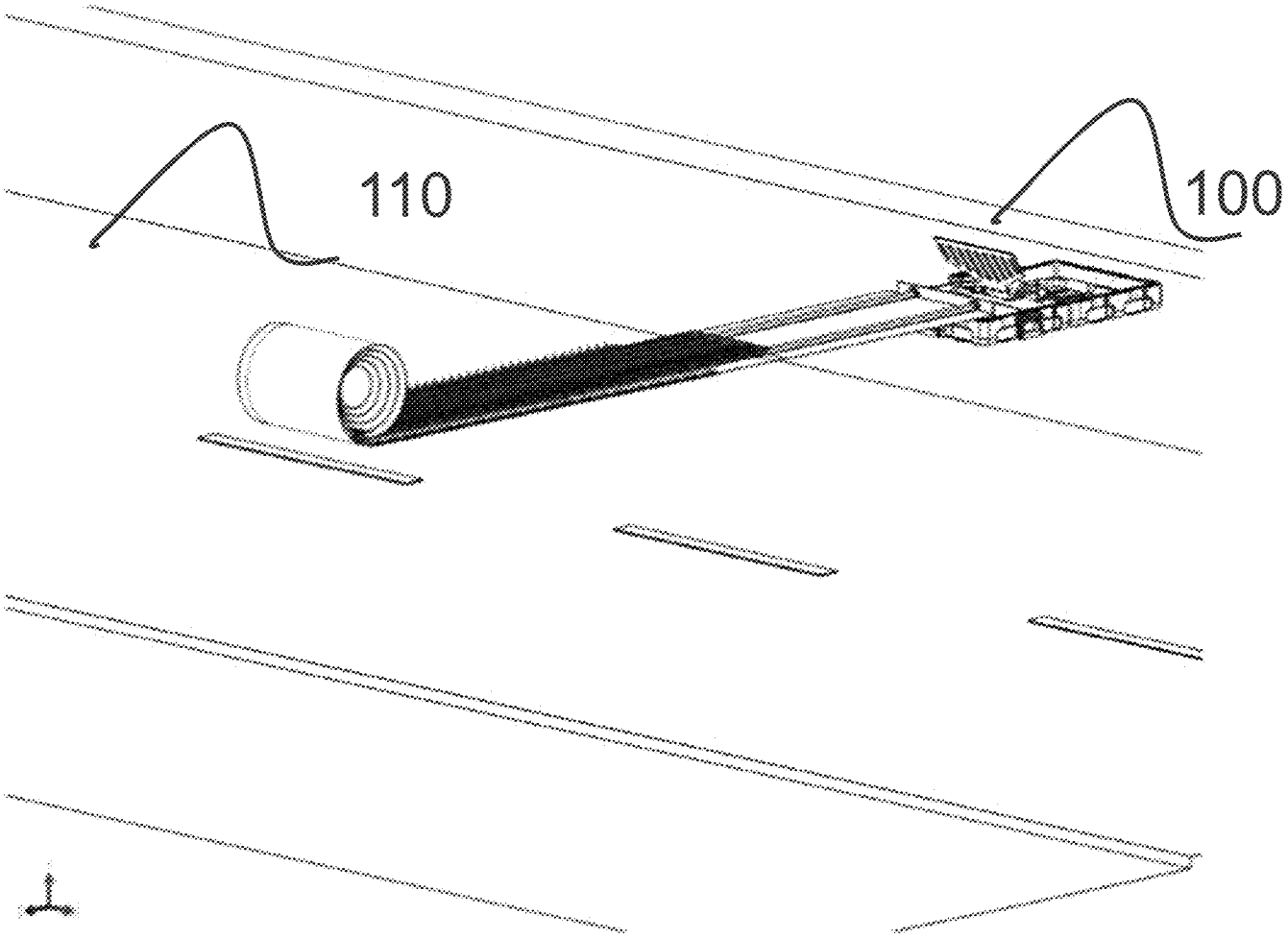
FIG. 1B is a schematic perspective view of the device of FIG. 1A in the process of deploying on a roadway according to an embodiment of the present disclosure.
Figure 1C:
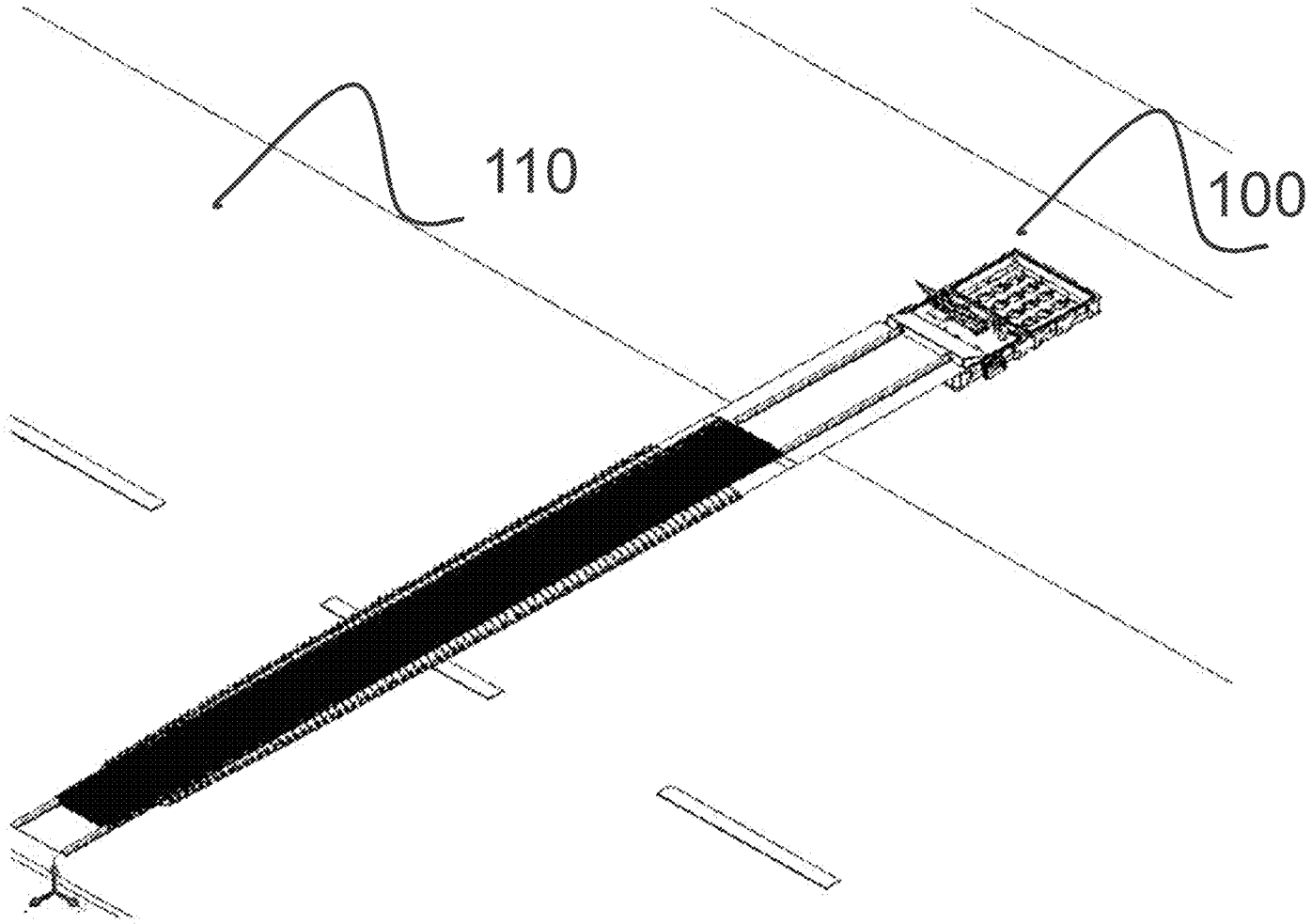
FIG. 1C is a schematic perspective view of the device of FIG. 1A after it has been deployed across a roadway according to an embodiment of the present disclosure.

As shown in FIG. 1B, as the device 100 is being deployed (either automatically via sensors or manually by remote signaling), a netting package unrolls across the expected pathway of the target vehicle as the targeted vehicle approaches the device 100. Upon deployment, as shown in FIG. 1C, the netting package is extended substantially across a roadway, or at least across a surface that a targeted vehicle is expected to traverse. The netting assembly includes a plurality of "penetrators" or spikes (or barbs, quills, caltrops, or other mechanisms) positioned to puncture or otherwise engage with the front tires of the targeted vehicle as it traverses the assembly. Each spike is tethered to the netting, and upon becoming lodged in a tire, the spike pulls the netting around the tire. The netting cinches the front tires, causing the vehicle to slow to a stop.

The device 100 may change from an undeployed to deployed state rapidly when the target vehicle is a short distance away, e.g., less than 100 feet. Quick deployment lessens the driver's opportunity to take evasive action to avoid running over the spikes and netting. Remote signaling capabilities enable the device operator (not shown) to move away from the target vehicle before deploying the device to reduce or eliminate the likelihood that the vehicle will strike the operator.

Overview of Housing, Netting Package, and Deployment Mechanism

Figure 2A:
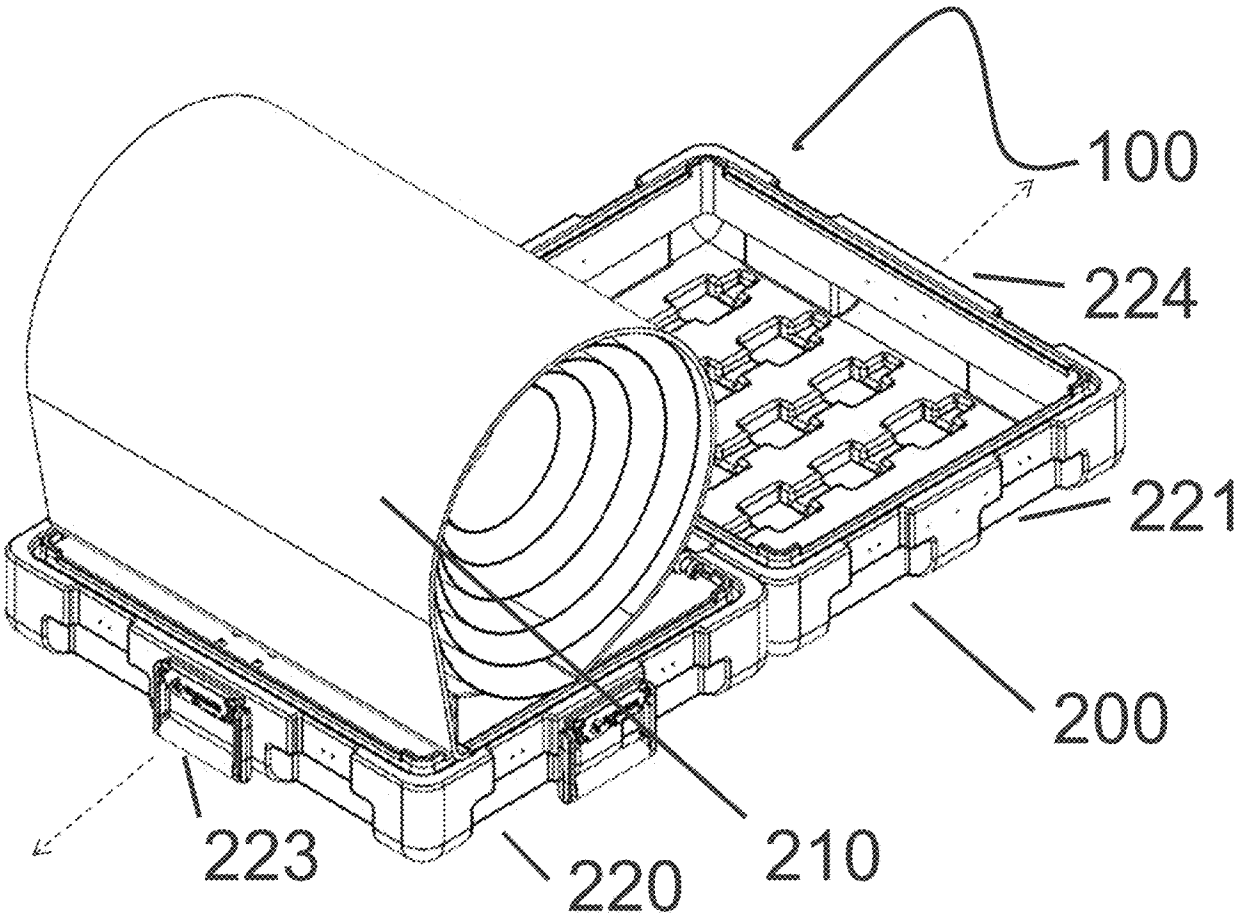
FIG. 2A is a schematic perspective view of the device of FIG. 1A, including a netting assembly, in a housing with the lid opened, according to an embodiment of the present disclosure.

FIG. 2A is a perspective illustration of device 100, loaded with a netting package, in an undeployed state according to an embodiment of the disclosure. As can be seen, device 100 can include a housing 200 (e.g., case, shell, or box) for storing components of the device. The housing can be closed for transporting and/or handling device 100 and may include a handle to facilitate carrying the unit and a lock for security. The housing 200 is depicted in FIG. 2A in a box-type configuration, but it can be in another shape as well. In one embodiment, the housing stores a deployment module for deploying a netting package along a roadway. In an alternative or additional embodiment, the housing stores both the deployment module and the netting package, such that the entire system is self-contained in the housing.

As shown in FIG. 2A, housing 200 can include a closable lid portion 221 and a base portion 220. The lid 221 can be manually opened for a user to arm or activate the device and in other embodiments, a switch can be tripped or otherwise a remote controlled signal can be used to arm the device once it is opened. In a further embodiment, a switch or remote controlled signal can cause the lid to open automatically. In some embodiments, the housing 200 can be made watertight (e.g., waterproof, water resistant) when closed and device 100 is in the undeployed state. In some embodiments (not shown), the housing 200 can further include a deployment ramp that a netting package, as described in more detail below, is configured to unroll or unfurl off of as it is deployed.

The housing 200 can be made of Delrin or other suitable materials. In some embodiments, the housing 200 can have dimensions equal to or substantially equal to 26"×21"×6". In some embodiments, the device 100 can weigh approximately 70 lbs.

As shown in FIG. 2A, in an undeployed state, the housing 200 either can contain a netting package 210 in a stowed position, or the netting package 210 can be placed into the housing once lid 221 is opened. For either embodiment, to be used, the device 100 is positioned with side 223 of the base 220 on, or adjacent to, a side of a roadway, oriented such that side 223 points toward the center of the roadway and side 224 points away from the roadway. When the device 100 is deployed, the netting package 210 unrolls over side 223 of the base 220 of housing 200 onto the roadway, as can be seen in FIG. 1A.

Figure 2B:
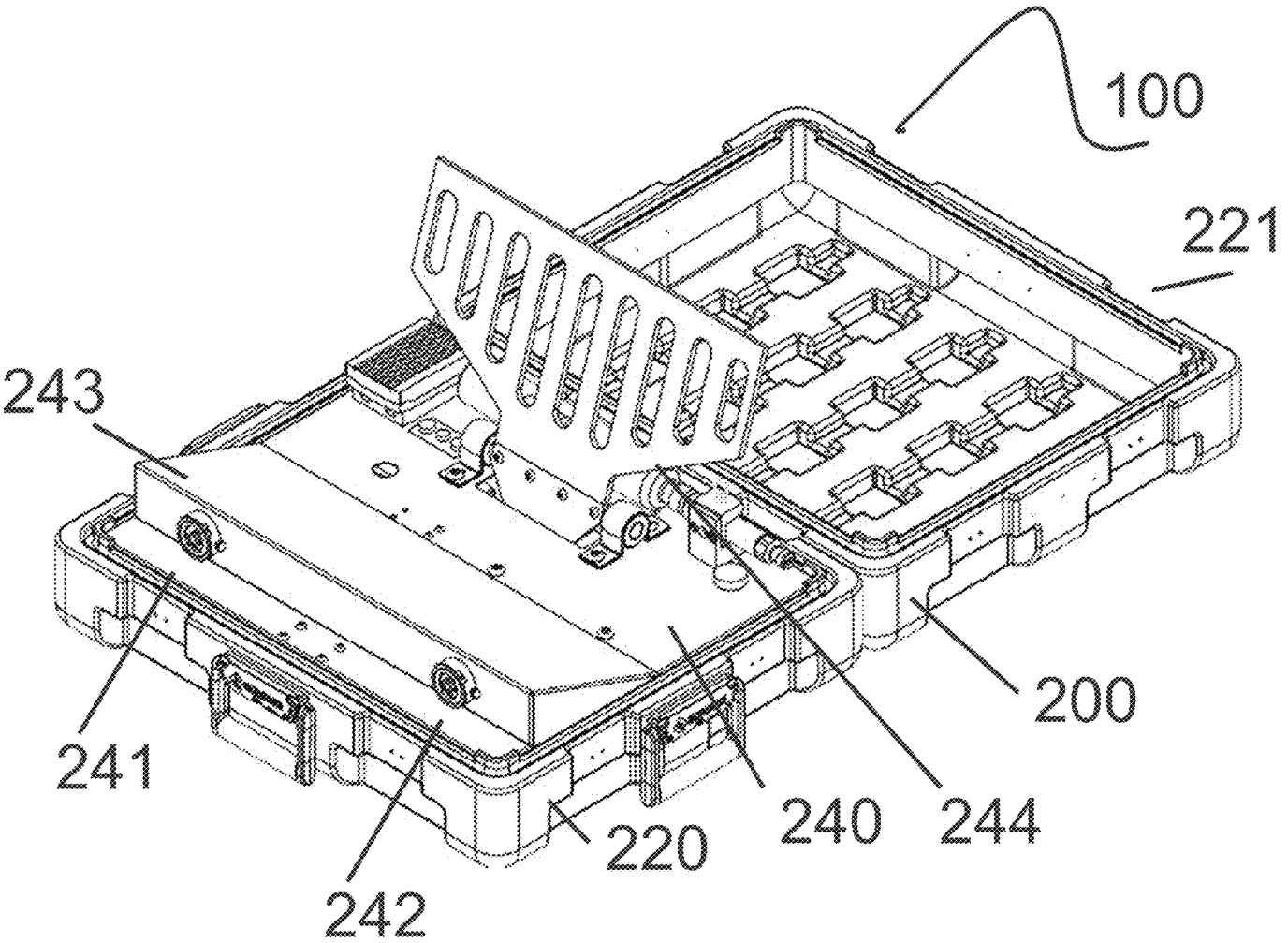
FIG. 2B is a schematic perspective view of the device of FIG. 1A, including a deployment module but without a netting assembly, in a housing with the lid opened, according to an embodiment of the present disclosure.
Figure 2C:
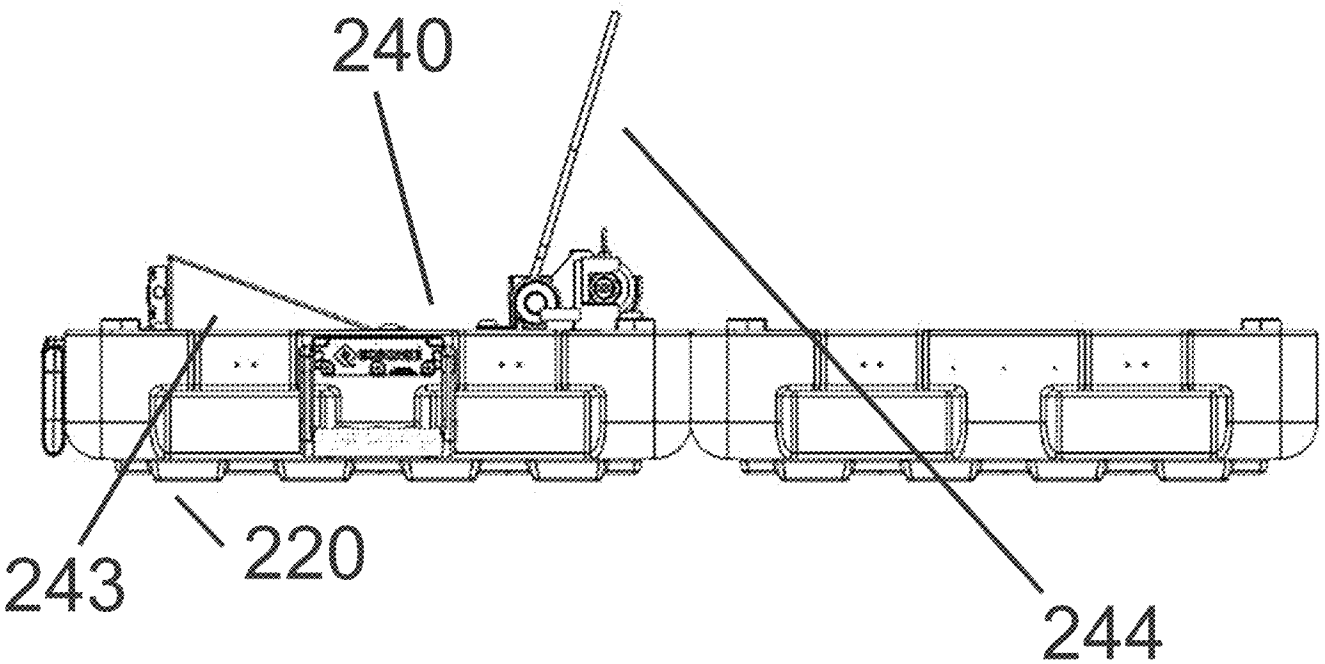
FIG. 2C is a schematic side view of FIG. 2B, with a kicker plate in pre-deployment position, according to an embodiment of the present disclosure.
Figure 2D:
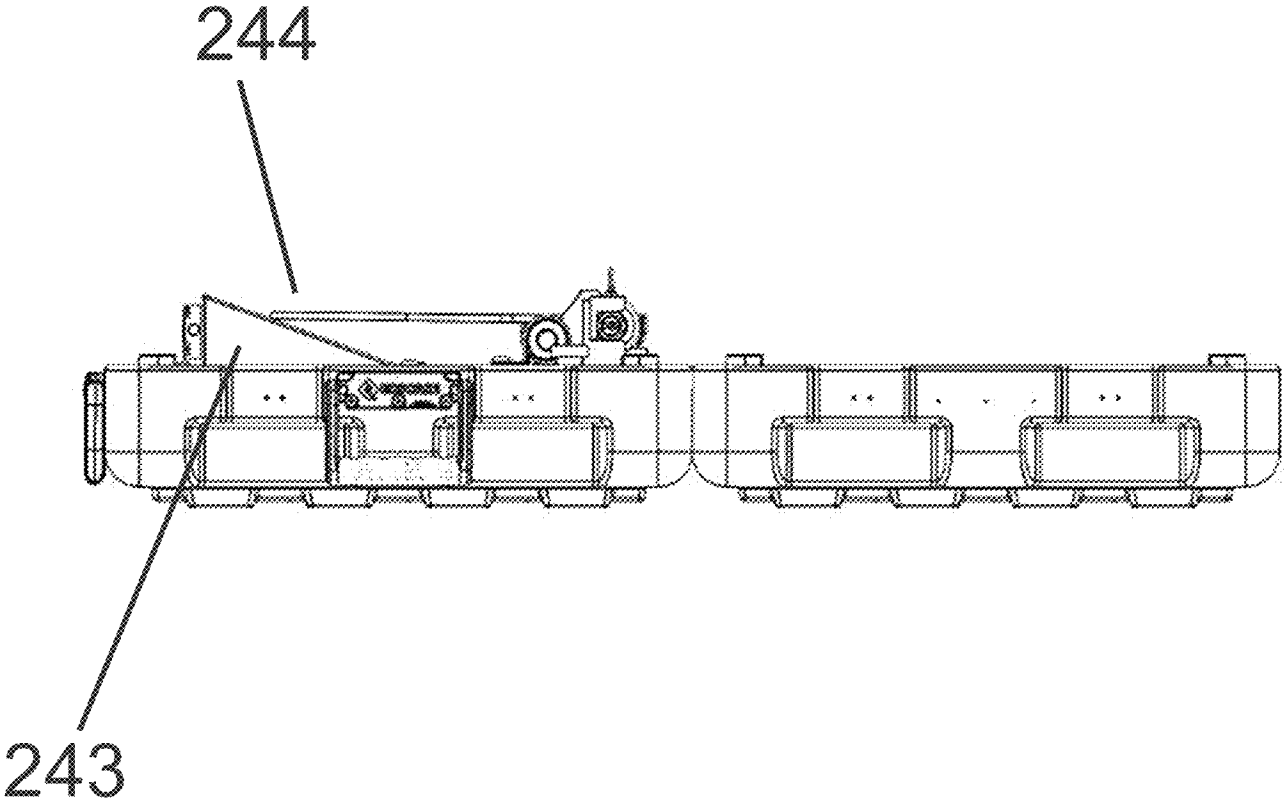
FIG. 2D is a schematic side view of FIG. 2B, with a kicker plate position for the unit it armed, according to an embodiment of the present disclosure.

FIG. 2B provides a view of the housing 200 without the netting package 210, revealing a deployment module 240 located in the base 220 of the housing. As will be described below in further detail, the deployment module 240 includes an inflation device with quick disconnecting nozzles 241 and 242. Deployment module 240 additionally includes a back plate 244 (e.g., a system kicker), which is part of a "pushing" mechanism that provides initial acceleration of the netting package 210 onto the roadway upon deployment. As shown in FIG. 2C, which is a side view of housing 200 with deployment module 240, the back plate 244 assists in holding the netting package 210 in the housing 200 while in the undeployed state. Ramp 243 of the inflator additionally cradles the netting package 210 in place while undeployed. FIG. 2D is a side view of the housing 200 and deployment module 240 with the back plate 244 positioned down so as to be flush against ramp 243, to enable the lid 221 to be closed. During use, a user opens the lid 221 and either pulls back plate 244 into position or activates the device to automatically position the back plate 244, before the user connects the netting package to the deployment module 240 in the housing. (This step would not be performed when using the alternative embodiment of the device, in which the netting package fits in the housing in the stowed condition with the lid 221 closed.)

Figure 2E:
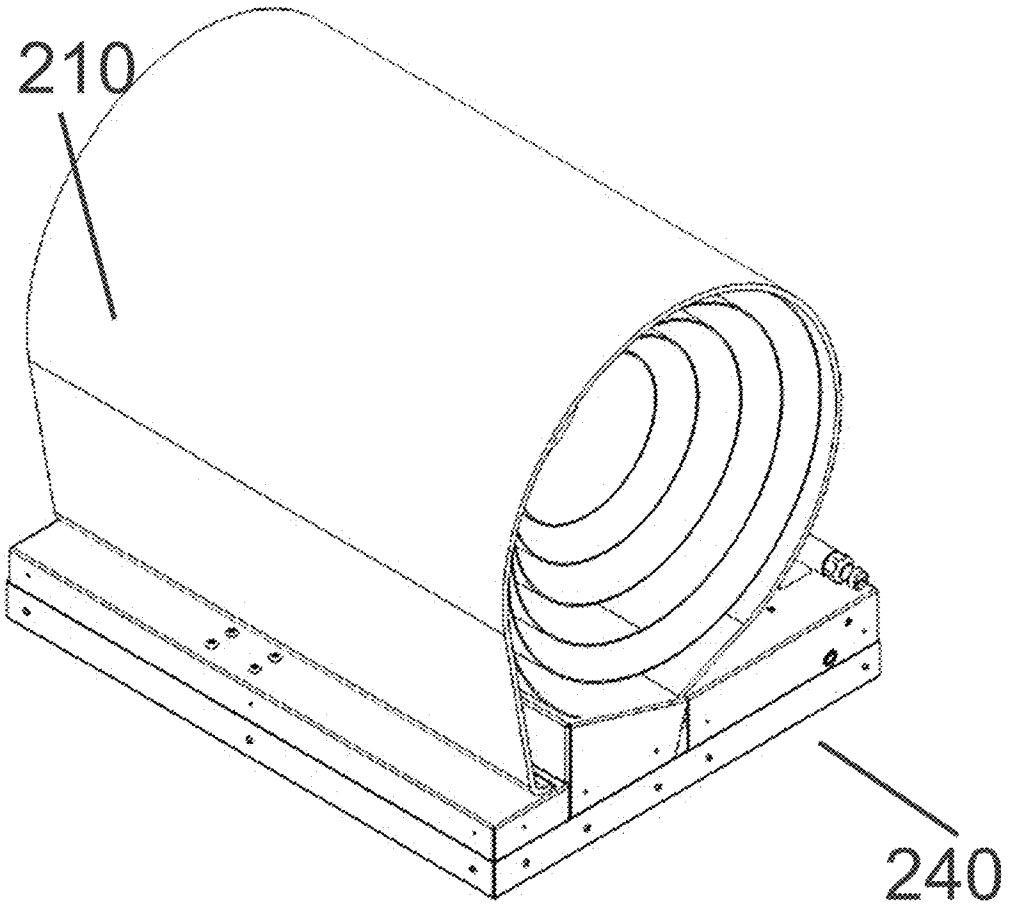
FIG. 2E is a schematic perspective view of a device including a netting assembly and deployment module, with a housing, according to an embodiment of the present disclosure.

As an alternative embodiment, FIG. 2E depicts the deployment mechanism 240 and netting package 210 of FIG. 2A without housing 200. The housing 200 is not necessary for the deployment mechanism 240 and netting package 210 to function.

Deployment Mechanism

Figure 3A:
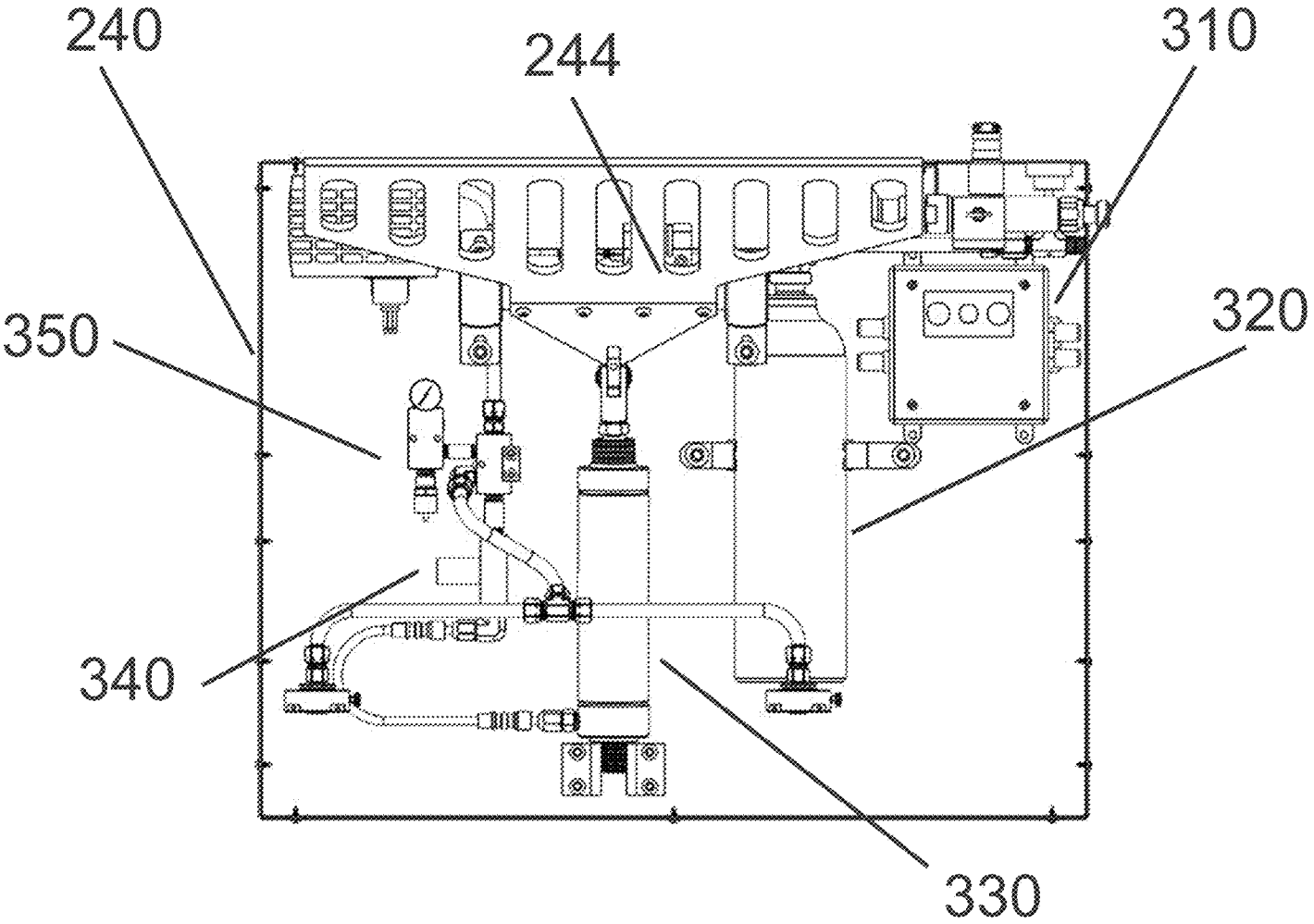
FIG. 3A is a schematic top view of a deployment module, with the top cover removed, of a vehicle immobilizing device, according to an embodiment of the present disclosure.

FIG. 3A illustrates a top view of deployment mechanism 240 with its top cover removed. The mechanism can include a power source (such as a battery pack, which may be rechargeable) operably connected to an inflation device to provide the device 100 with a pneumatic and/or electrically operated deployment mechanism. The device 100 additionally can include a triggering or initiating device, control system, sensor(s), reservoir, tank, pressure gauge, valve(s), electronic control, control panel, circuit(s), switch, microprocessor, cable(s), and/or pressure regulator, as disclosed in U.S. Patent Publication No. 2015/0063906, entitled "APPARATUS AND METHOD FOR RAPIDLY IMMOBILIZING A LAND VEHICLE," which is incorporated herein by reference in its entirety.

Particularly, deployment mechanism 240 can include electronics 310, an accumulator bottle 320, a kicker cylinder 330, a flow control valve 340, and a relief valve and pressure gauge 350. In some embodiments, the electronics 310 can receive and respond to remote signaling, for example, to arm, commence deployment, perform built-in-test, and/or provide feedback on status. The electronics 310 can communicate, for example, via RF, IR, Bluetooth, WiFi, or cellular protocols. The electronics module 310 receives power from a battery (such as a rechargeable battery) and, to commence deployment, it signals the kicker cylinder 330 to move the kicker plate 244 while also signaling the accumulator bottle 320 to begin inflating bladder hoses in the netting package (not shown).

Figure 3B:
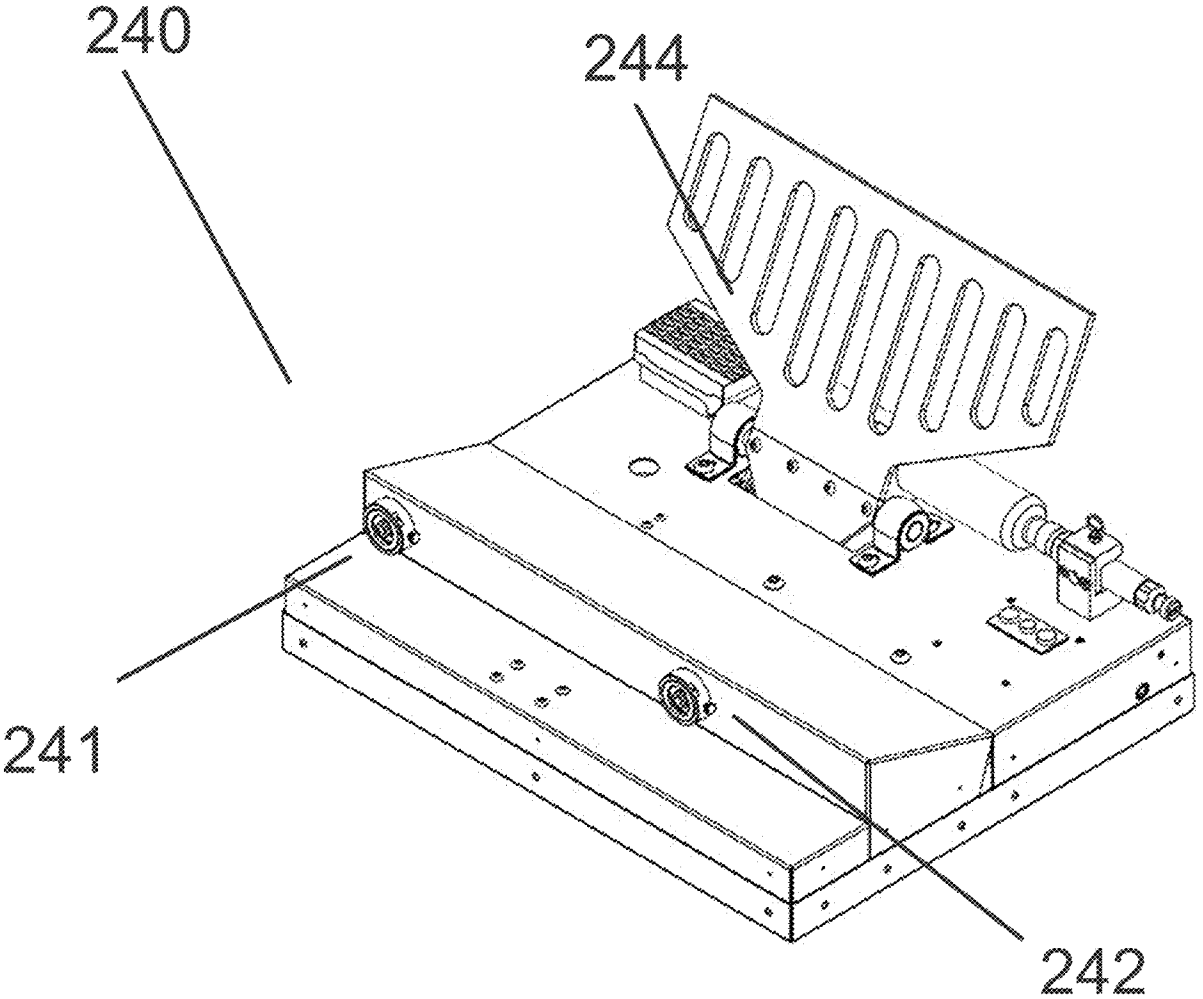
FIG. 3B is a schematic perspective view of the deployment module of FIG. 3A, according to an embodiment of the present disclosure.

FIG. 3B illustrates an assembled view of the deployment module 240, including the quick disconnect ports 241 and 242 in inflator ramp 243. As described below, these ports connect with bladder hoses in the netting package so as to rapidly unroll the netting package during deployment. The quick disconnect ports allow the one or more bladders (not shown) to attach and then detach or disconnect from the housing 200, for example, at a pre-determined force. Such features allow the bladders (and/or the netting package) to disconnect from housing 200, for example, in the event that the wheels of a target vehicle begins to pull on the deployment module of device 100 as the vehicle is being captured, which could cause damage to the device 100.

In certain embodiments, the device 100 can include pressure gauge, system armed, system reset, and/or fire indicators visible on an interior or exterior portion of the housing 200.

FIG. 13 illustrates a summary of results of pressure tests conducted to optimize flow control and rate of pressure for the system kicker and accumulator bottle according to a particular embodiment of the present technology of device 100. A 36 ply net was used for these particular tests. Lower ply nets can be expected to have deployment times less than 3 second due to their reduced weights.

Netting Package

Figure 4A:
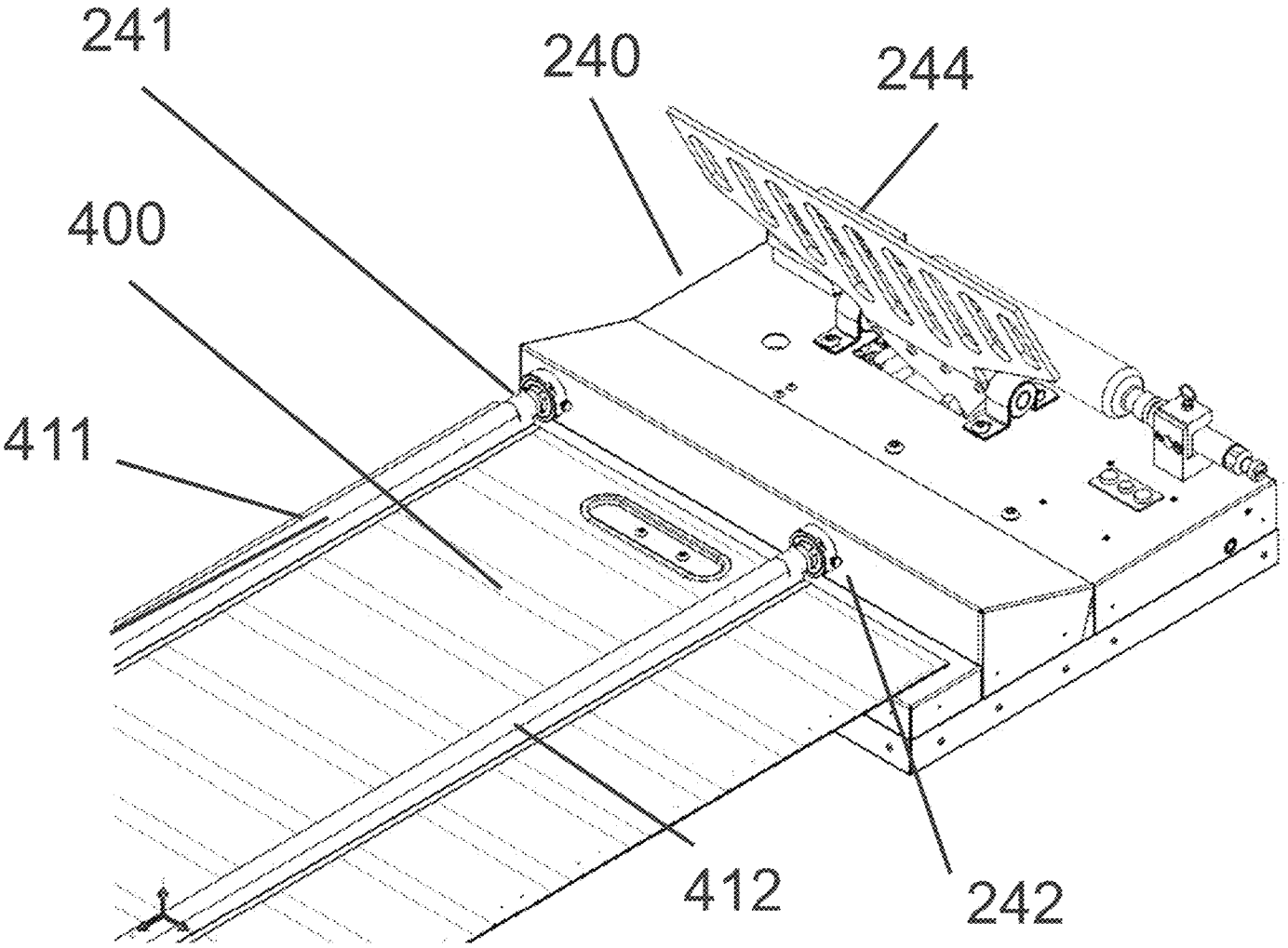
FIG. 4A is a schematic perspective view of the deployment module of FIG. 3B connected to a deployed base layer, according to an embodiment of the present disclosure.

FIG. 4A illustrates the connection of the deployment module 240 to the base layer 400 of the netting package 210 when in a deployed state. In this state, the kicker plate 244 is tilted forward and the inflator (not shown) has inflated bladder hoses 411 and 412 attached to the base layer of the netting package 210, causing the netting package (not shown) to unroll across a roadway. The base layer 400 (e.g., backing, surface) can be continuous or can be a set of attached portions, and is flexible such that it can be stowed (e.g., rolled, retracted) into a roll (e.g., a cylindrical or tubular roll). For example, the base layer 400 can be rolled into a series or loops, rings, and/or rolls around each other. The base layer 400 can be, for example, a flexible, e.g., non-rigid, cover and/or shell made of fabric or another suitable non-rigid material. In some embodiments, one or more sheets 420 (e.g., made of carbon fiber or another suitably strong and lightweight material) can extend along the width and/or length of the base layer 400, e.g., between top and bottom portions, over a top portion, and/or under a bottom portion of the base layer 400 to provide support and/or reinforcement.

Figure 4B:
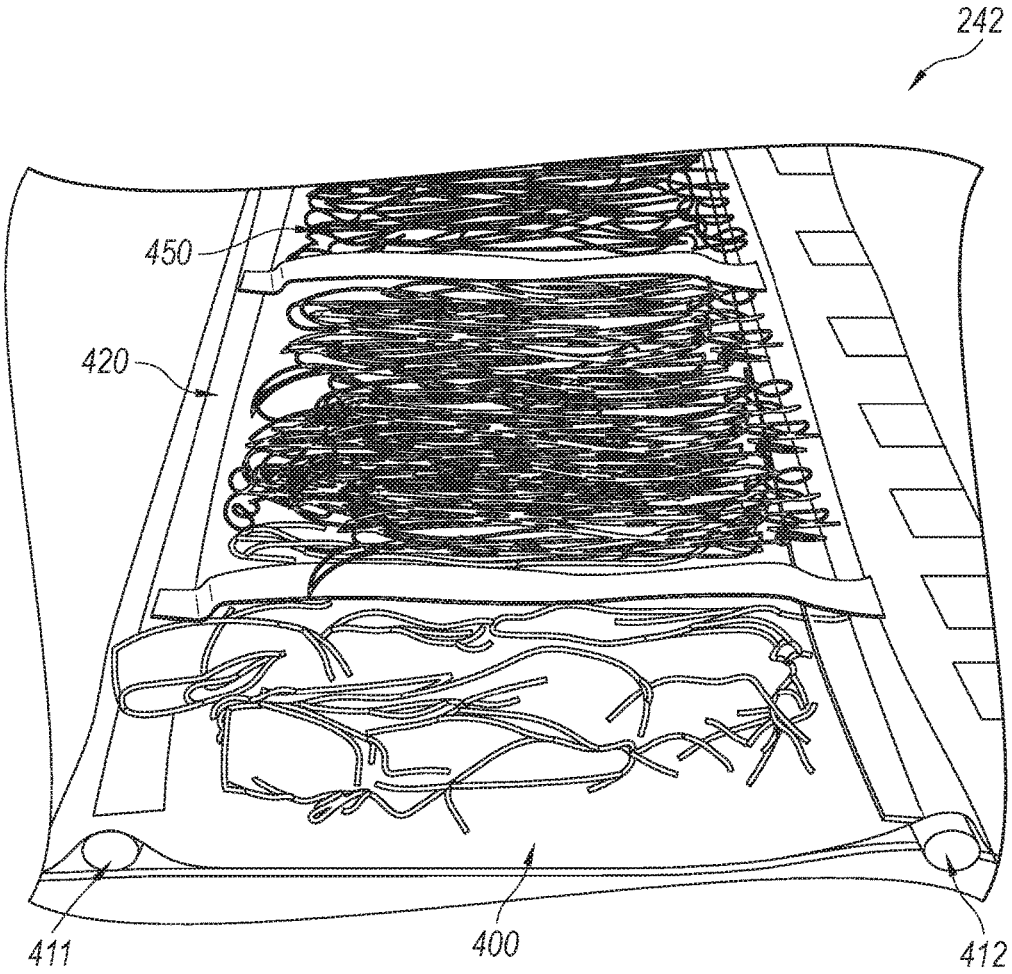
FIG. 4B illustrates a netting assembly of the device of FIG. 1A, including a base layer, netting, and inflation hoses, according to an embodiment of the present disclosure.

As shown in FIG. 4B, the base layer 400 provides a surface (e.g., as a continuous and/or non-rigid backing) suitable for supporting an assembly that includes inflatable hoses 411 and 412, netting 450, and spikes (not shown), as will be described below. The size of the base layer 400 may affect how far the netting 450 extends in the deployed arrangement, e.g., a shorter base layer 400 may result in shorter netting 450 being deployed for a narrow roadway.

Returning to FIG. 4A, an inflator device in the deployment module 240 can include a pressure source, e.g., a pressurized gas cylinder, gas generator, an accumulator, etc., operably coupled to one or more bladders 411 and 412 of the base layer 400. The bladders are configured to deploy the netting package when expanded as described in more detail below. The inflator device may also include a sensor (not shown) for sensing an approaching vehicle and automatically deploying the netting package. Examples of suitable sensors may include magnetic sensors, range sensors, or any other device that can sense an approaching vehicle and deploy the netting package before the vehicle arrives at the device 100. The inflator device may alternatively or additionally include a remote actuation device (not shown) for manually deploying the netting package. The sensor and/or the remote actuation device may be coupled to the device 100 by wires, wirelessly, or another communication system for conveying a "deploy signal" to the device 100. Examples of wireless communication technology include electromagnetic transmission (e.g., radio frequency) and optical transmission (e.g., laser or infrared).

FIG. 4A illustrates the base layer 400 connected to the deployment module in a deployed state. As can be seen, the base layer 400 is unfurled (e.g., unrolled, uncoiled, extended) when the device 100 is deployed. The netting 450 of the netting package, which is not shown in FIG. 4A, is configured to extend across, or at least substantially the length across, a roadway (or other ground surface), on top of the base layer 400 as the device 100 is being deployed. The base layer 400 rests against the roadway or other surface. The first bladder 411 and second bladder 412 are mounted or secured to the base layer 400 (e.g., by stitching, glue, Velcro, etc.) and configured to extend along the length of the netting package. The bladders, in response to being inflated by the pressure source, expand to deploy the base layer 400 and corresponding netting 450 of the netting package. Certain embodiments according to the present disclosure include tubular bladders, e.g., hoses, mounted lengthwise along the netting package, the bladders are also rolled into a roll when the netting package is in the stowed position. The bladders can be fluidly coupled to the pressure source via one or more connectors 241, 242 extending from and/or through a portion of the housing 200 from the pressure source.

As each bladder starting at a first (e.g., outer) edge or end of the bladder adjacent a base of the housing 200 is inflated and continuing to a second (e.g., inner) edge or end adjacent a center of the rolled netting package, the expanding bladder unfurls, e.g., unrolls, uncoils, extends or otherwise begins to deploy the base layer 400 until the netting package is deployed. Once unfurled or deployed, the first end and second ends of each bladder are positioned at opposing ends lengthwise of the deployed netting package. The back plate 244 (e.g., a system kicker) positioned at the rear of the base of the housing 200 can act as a reaction surface for the base layer 400 to push-off against as it unfurls to the deployed state and/or act as a pushing mechanism to provide initial acceleration of the netting package and/or to assist in holding the netting package in the housing 200. Velcro or other suitable fasteners, e.g., an adhesive, bolts, pins, etc., can also secure the base layer 400 to the housing 200 as the netting package is unfurled.

Figure 5A:
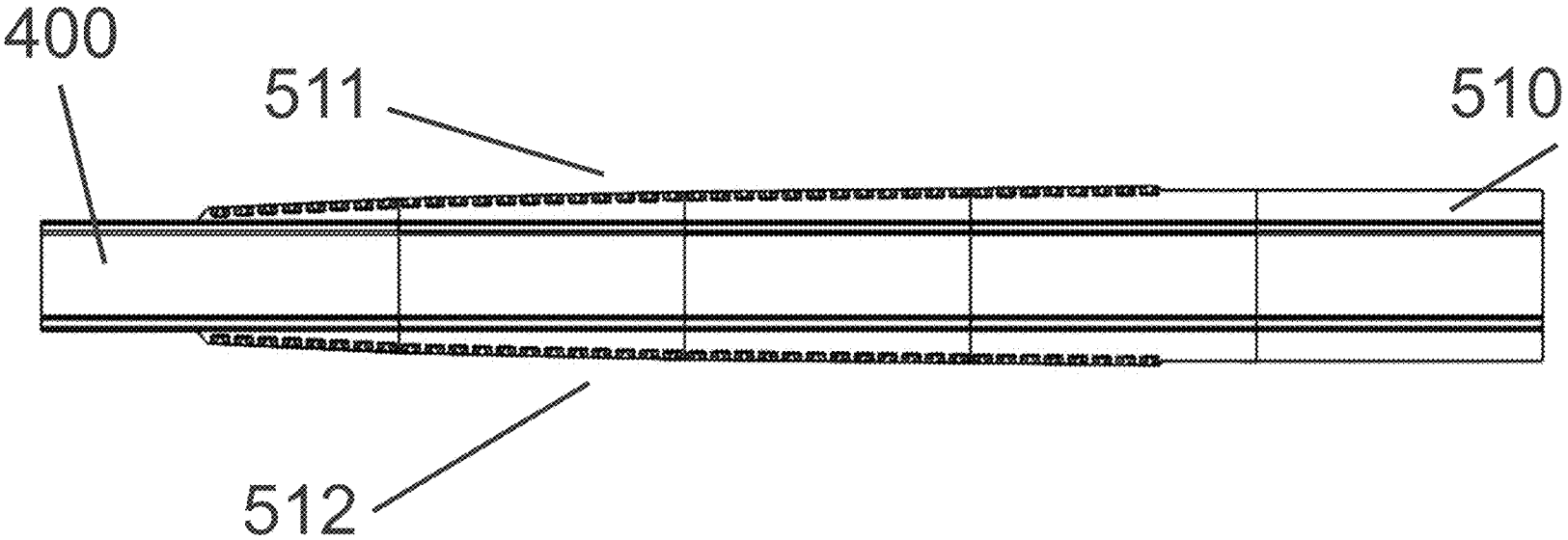
FIG. 5A is a top view illustration of a base layer including spike nests arranged in two rows at the lengthwise edges of the base layer of the device of FIG. 1A, according to an embodiment of the present disclosure.
Figure 5B:
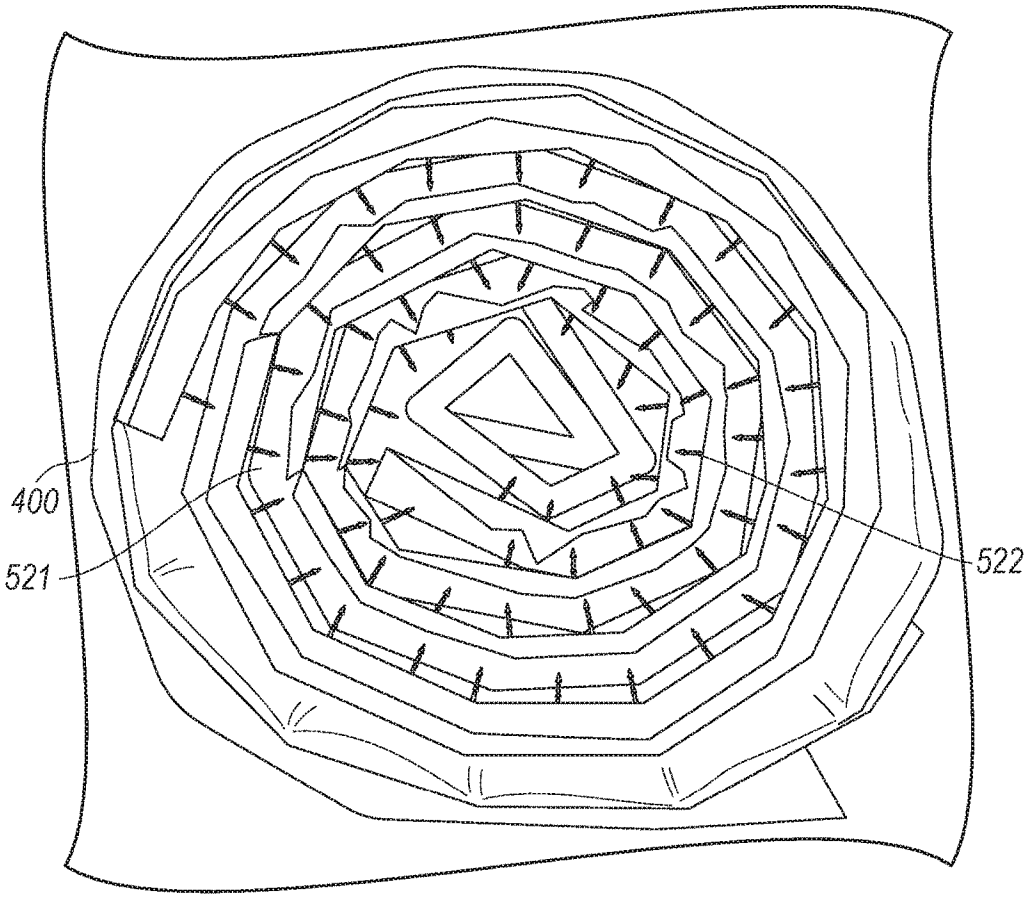
FIG. 5B illustrates a side view of a netting assembly, including a base layer and spikes positioned at the lengthwise edge of the base layer of the device of FIG. 1A, according to an embodiment of the present disclosure.

In an embodiment of the present disclosure, as shown in FIG. 5A, a series of spike holders are attached to both length-wise edges of base layer 400. The spike holders can be attached by rivots, glue, stitching, Velcro, or they may be bolted to the base layer 400. The spike holders are positioned at the periphery of a tapered edge 510 of the base layer. The edge is tapered such that, when the base layer is in its rolled configuration, the protrusions caused by the spikes in the spike holders do not contact against and become lodged in other areas of the base layer. FIG. 5B illustrates a side-view of the base layer 400 in a rolled configuration, with spikes attached at the edge. As can be seen, the edge appears as concentric loops (such as 521 and 522) in which the width of the base layer continually widens, such that the spikes at the edges do not contact against the edge in the preceding loop. In FIG. 5A, the spike holders are arranged linearly in groups 511 and 512. In this manner, when a land vehicle traverses the base layer 400, it will encounter spikes at the leading edge, no matter from which direction the vehicle is traveling.

Figure 5C:
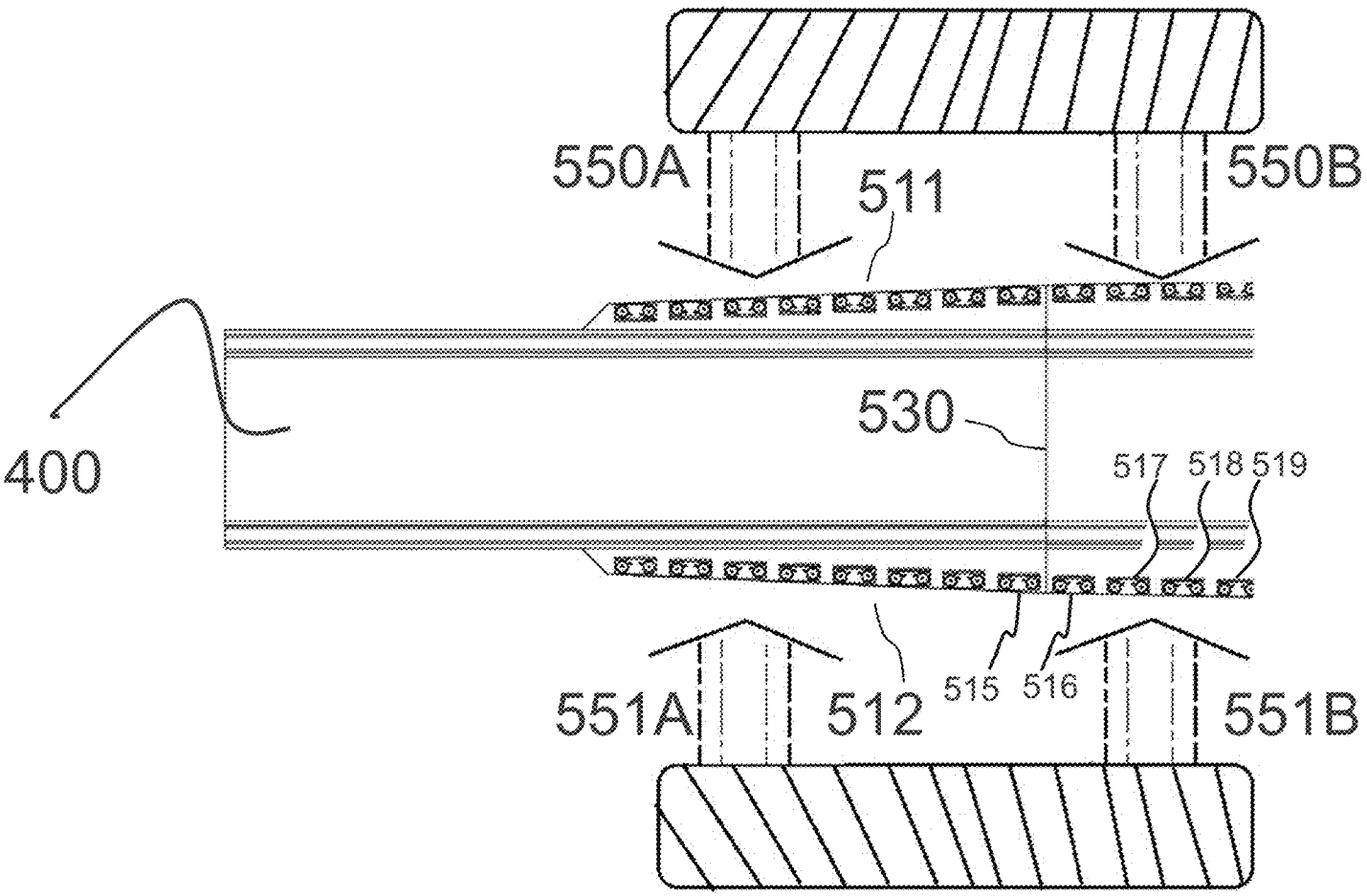
FIG. 5C is a top view close-up illustration of a base layer of FIG. 5A, including spike nests arranged in two rows at the lengthwise edges of the base layer, according to an embodiment of the present disclosure.

FIG. 5C is a close-up of a section of base layer 400 from FIG. 5A in accordance with an embodiment of the present disclosure. As can be seen, the tapered edges 511 and 512 include a plurality of discrete, attached receptacles, or spike holders, such as 515, 516, 517, adjacent to each other. For each receptacle, two circular sections, such as 518 and 519, are formed therein for receiving and retaining a spike. The receptacles are spaced apart along the base layer 400 in a manner such that the base layer 400 can easily flex in the area between receptacles to be rolled and stowed when in an undeployed state. At the same time, the receptacles are sufficiently close together so that each front tire of an incoming vehicle coming from either direction will engage with at least one receptacle. For example, in FIG. 5C, shaded areas/dashed lines 550*a* and 550*b* represent a path of front tires from an oncoming vehicle in one direction, and shaded areas/dashed lines 551*a* and 551*b* represents the path if the vehicle is traveling in the opposite direction. Either way, the vehicle's two front tires should each traverse at least two circular sections from the receptacles, thus ensuring contact with at least one, if not multiple spikes per tire when spikes are fitted into the receptacles.

As can also be seen from FIG. 5C, the base layer 400 may be comprised of multiple sections that are attached to each other, such as at joint 530.

As an alternative embodiment, base layer 400 can be configured such that the receptacles and spikes are arranged linearly on a single lengthwise edge.

Figure 6A:
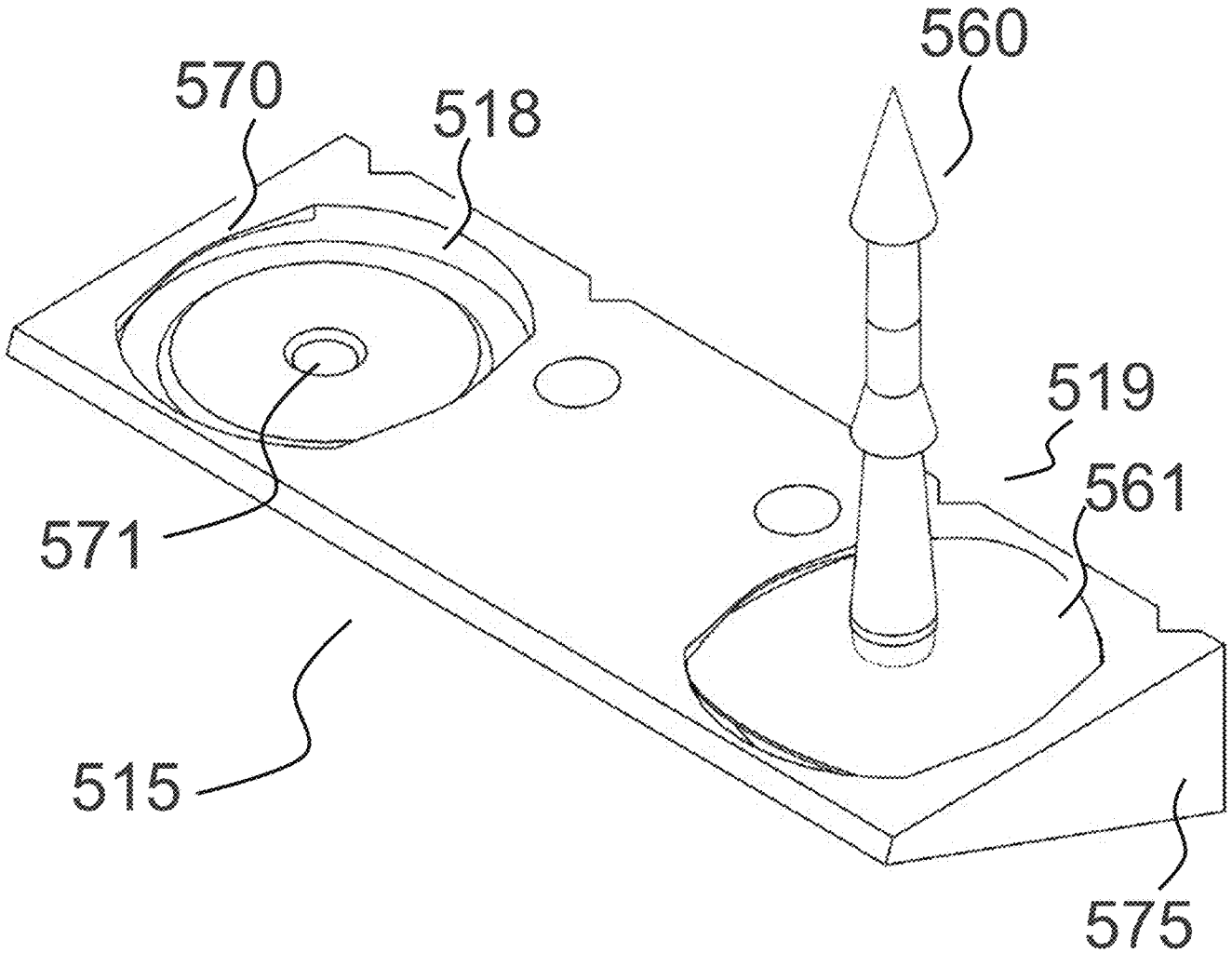
FIGS. 6A-6C are schematic perspective and side views of a spike nest and an example spike for inclusion in the device of FIG. 1A, according to an embodiment of the present disclosure.
Figure 6B:
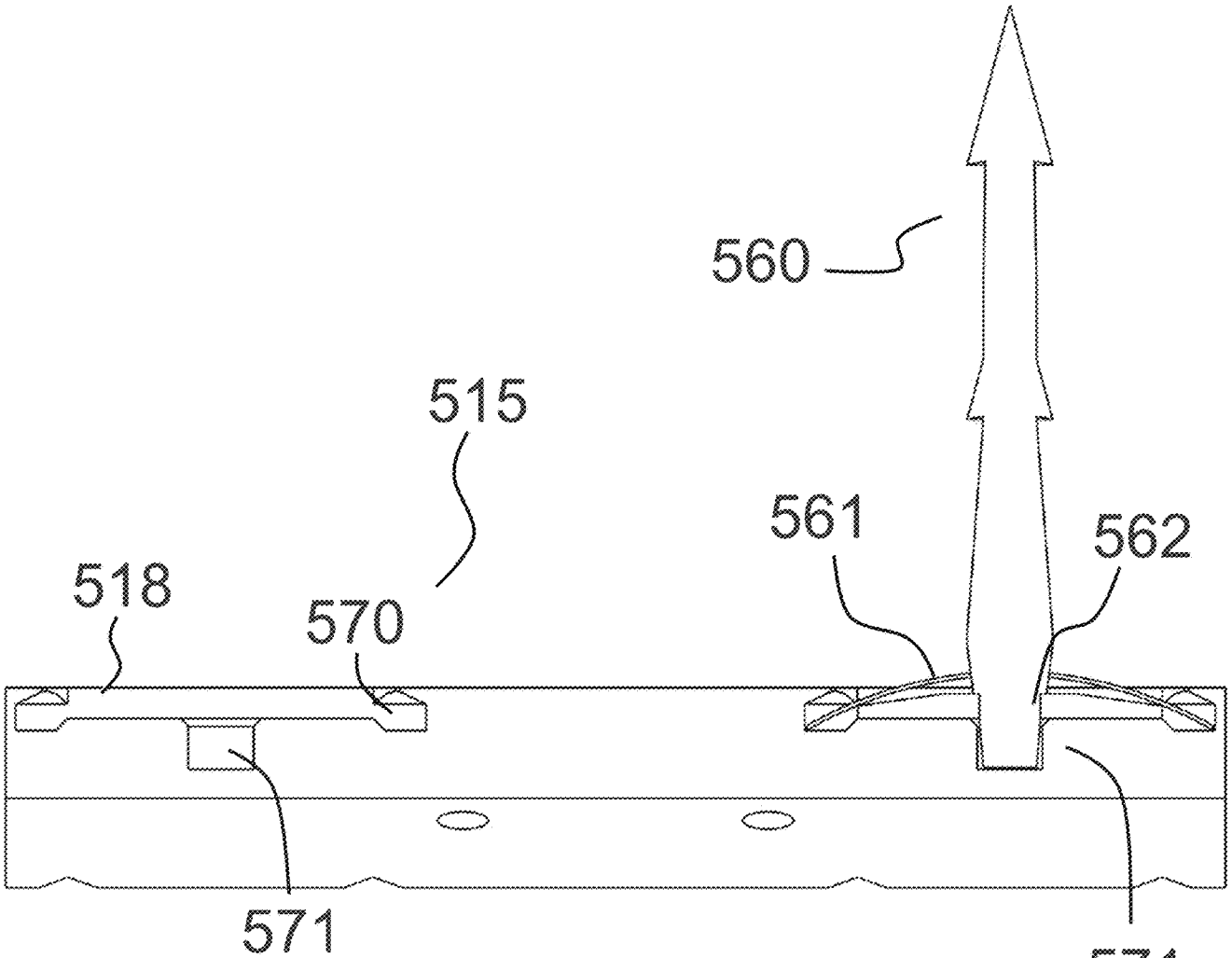
Figure 6C:
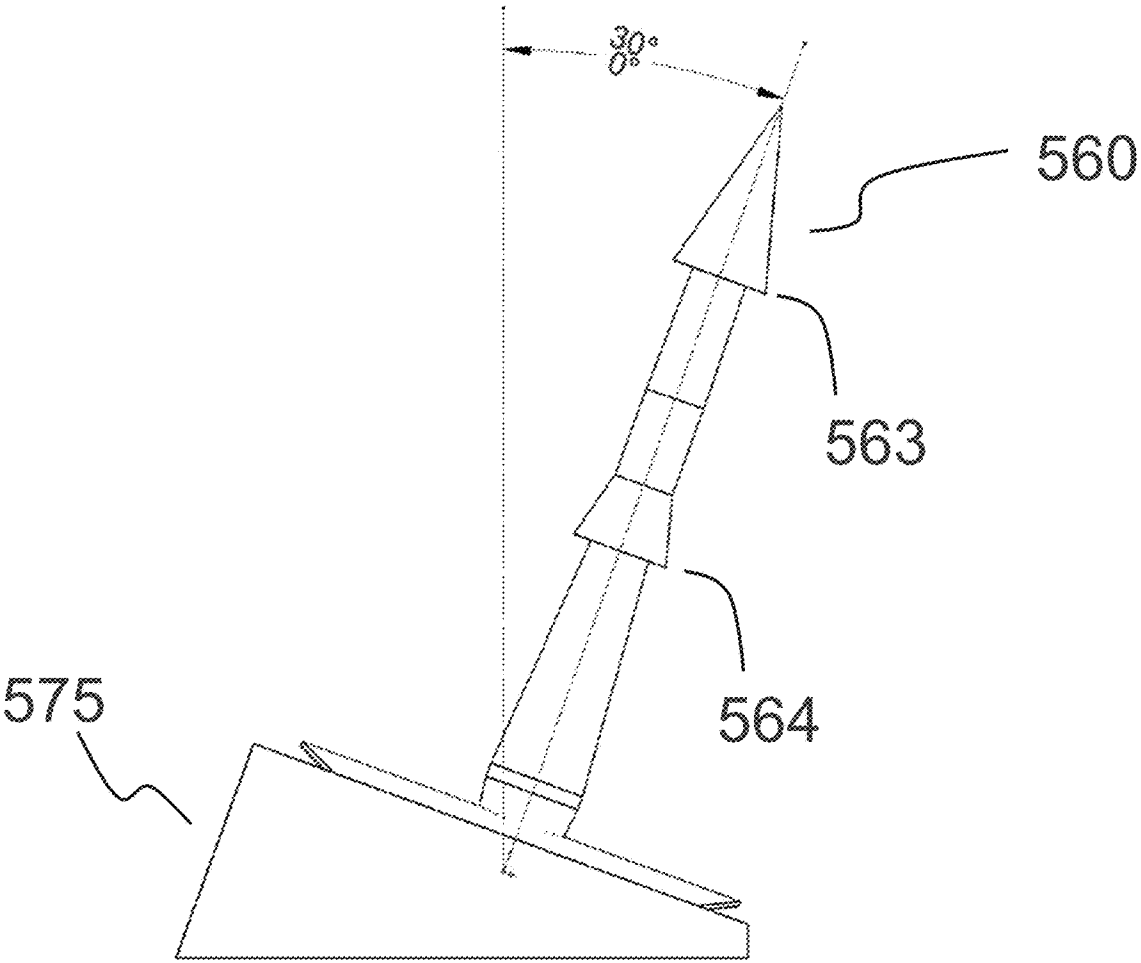

FIGS. 6A-6C are detailed views of a receptacle, or spike holder (such as 515), in accordance with an embodiment of the disclosure. The receptacle includes two substantially circular sections 518 and 519 to be fitted with spikes, such as spike 560. The receptacle acts as a "spike nest" to temporarily house spikes until at least one spike from one receptacle punctures the tire of an oncoming vehicle. The receptacles can be made of rigid plastic (or other lightweight material). Arranged in a row, the receptacles each hold a plurality of spikes in place, vertically and/or at an angle that facilitates having the spikes 560 penetrate into the tires of an oncoming vehicle when the base layer is unfurled for deployment. The receptacle can be a wedge shape or other shape having a flat, inclined or ramped surface. In the deployed configuration, the spikes 560 are aligned facing the same direction, along with the receptacle 515. When deployed, the receptacles are angled such that the tip of each spike is leaning in the direction away from the netting, so that the spike will be leaning toward an oncoming vehicle.

As can be seen in FIGS. 6A-6C, substantially circular section 518 of receptacle 515 forms an outer lip 570 and a further depressed circular area 571. These enable spike 560 to be closely fitted and supported by the receptacle. Each spike 560 includes a flexible disc 561 that can be fitted within lip 570 to keep the spike in place. The flexible disc 561 is positioned above the circular metal base of the spike. The spikes also include a small tail area 562 that extends beneath the base and fits within the depressed circular area 571 of the receptacle.

The receptacle platform is angled, as shown by side 575 in FIGS. 6A and 6C, such that a spike that is fitted in a receptacle at a designated angle. In FIG. 6C, the receptacle is configured to position the spike at a 30° angle. In alternative embodiments, the receptacle can be configured to position the spike at a 0° angle, or some other angle (including some angle between 0°-30°).

As shown in FIG. 6C, the spike 560 includes a sharp tip or point for piercing and penetrating into a tire. The spike includes double barbs or two or more barbs (identified individually as first barb 563 and second barb 564) spaced axially apart along a shaft or stem portion of the spike 560. The barbs extend radially outward from the shaft or stem portions of the spike 560 to prevent or restrict back-out or pull-out of the spikes once they penetrate into the tires of a vehicle. The individual barbs can extend at different angles away from a longitudinal axis of the shaft of the spike 560. In some embodiments, the second barb 564 positioned at a greater distance axially from the tip of the spike 560 extends at a larger angle away from the longitudinal axis of the shaft than the first barb 563 positioned more proximate to the tip of the spike 560. In some embodiments, the second barb 564 extends at a smaller angle away from the longitudinal axis of the shaft than the first barb 563. In other embodiments, the barbs extend at substantially the same angle away from the longitudinal axis of the shaft. The spikes 560 can be of a solid or non-hollow construction, or alternatively, the spikes can be hollow.

Figure 6D:
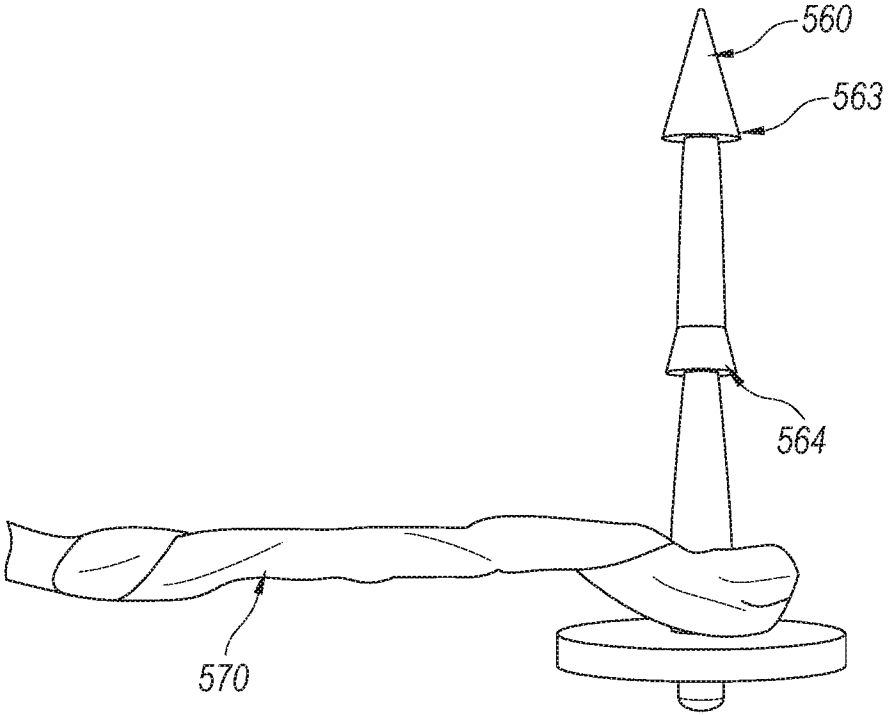
FIG. 6D illustrates a spike and a tether to netting for the device of FIG. 1A, according to an embodiment of the present disclosure.

FIG. 6D illustrates a spike having a tether 570, which connects the base of the spike to netting (not shown). The tether 570 can be slided onto the shaft spike such that the flexible disc 561 is located between the metal circular base and the tether. When the device 100 is deployed, at least one tire of an oncoming vehicle is punctured by a spike 560. The spike is then lodged in the tire, and is pulled from the receptacle 515 as the retaining disc bends out of the lip 570 of the receptacle. Via the tether 570, the netting is pulled from the base layer 400. The tethers 570 may couple individual meshes and/or multiple meshes at a leading edge of the net to corresponding spikes 560. Individual tethers 570 may be made of the same material as the net or any other material that is suitable for coupling the spikes 560 and the net. Loops may be formed at either end of the tether 570 by known weaving or braiding techniques.

Figure 7A:
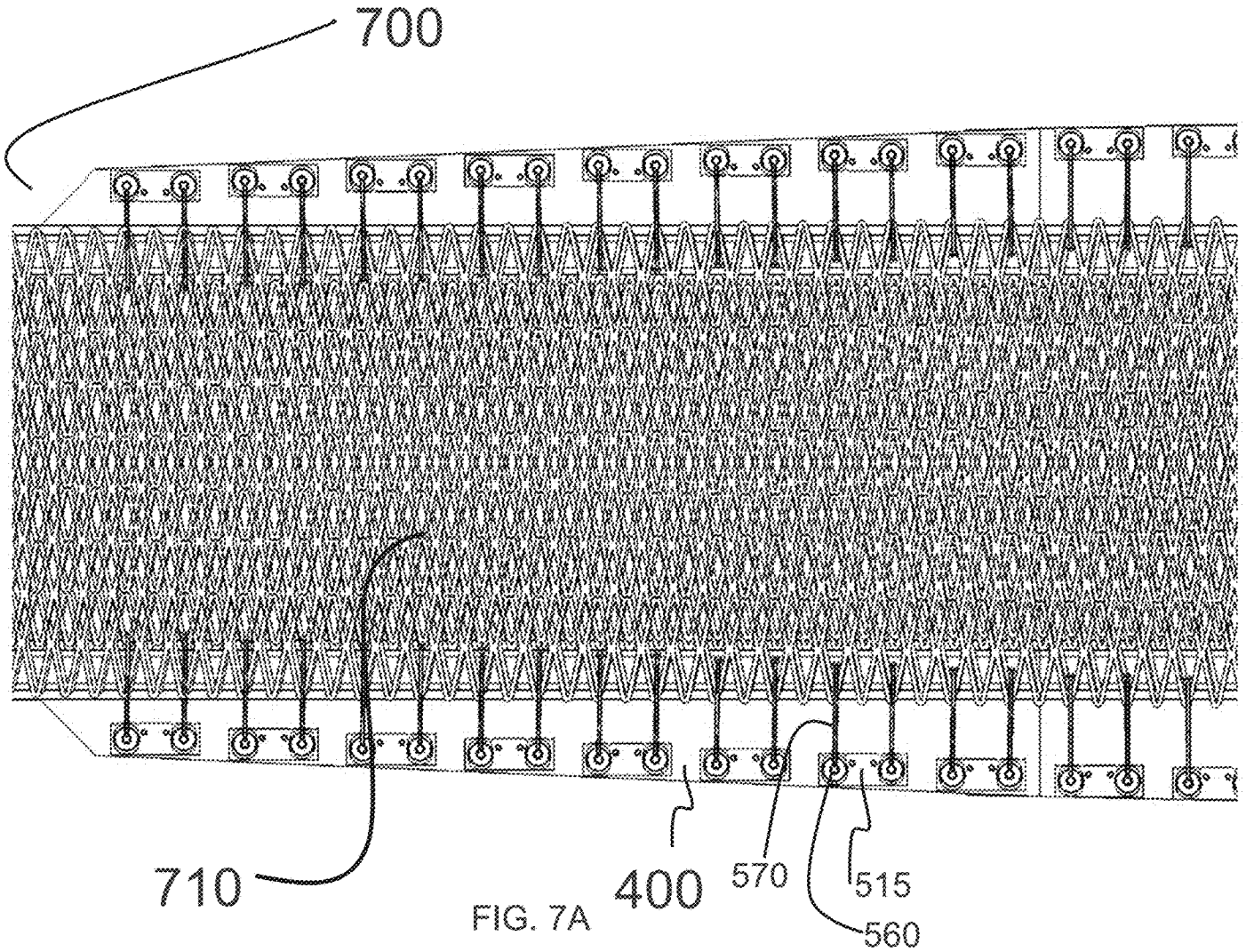
FIG. 7A is a top view schematic of a netting assembly, including netting, tethers, spike nests, and spikes, for use in the device of FIG. 1A, according to an embodiment of the present disclosure.

FIG. 7A illustrates netting assembly 700, which is primarily comprised of base layer 400 and netting 710. The netting 710 includes tethers 570, which connect to the retaining disc of spikes 560, which are positioned in receptacles (or "spike nests") 560. The netting 50 can be removably secured (e.g., configured to tear-away) from the base layer 400 via one or more Velcro fastener strips or patches (not shown). In other embodiments, other suitable fasteners can be used to removably secure the netting 710 to the base layer 400. Additionally, one or more straps extending laterally across the base layer 400 between leading edge and trailing edge of the base layer 400 can assist in removably securing the netting 710 to the base layer 400. Details of the netting 710 are described in more detail below.

Figure 7B:
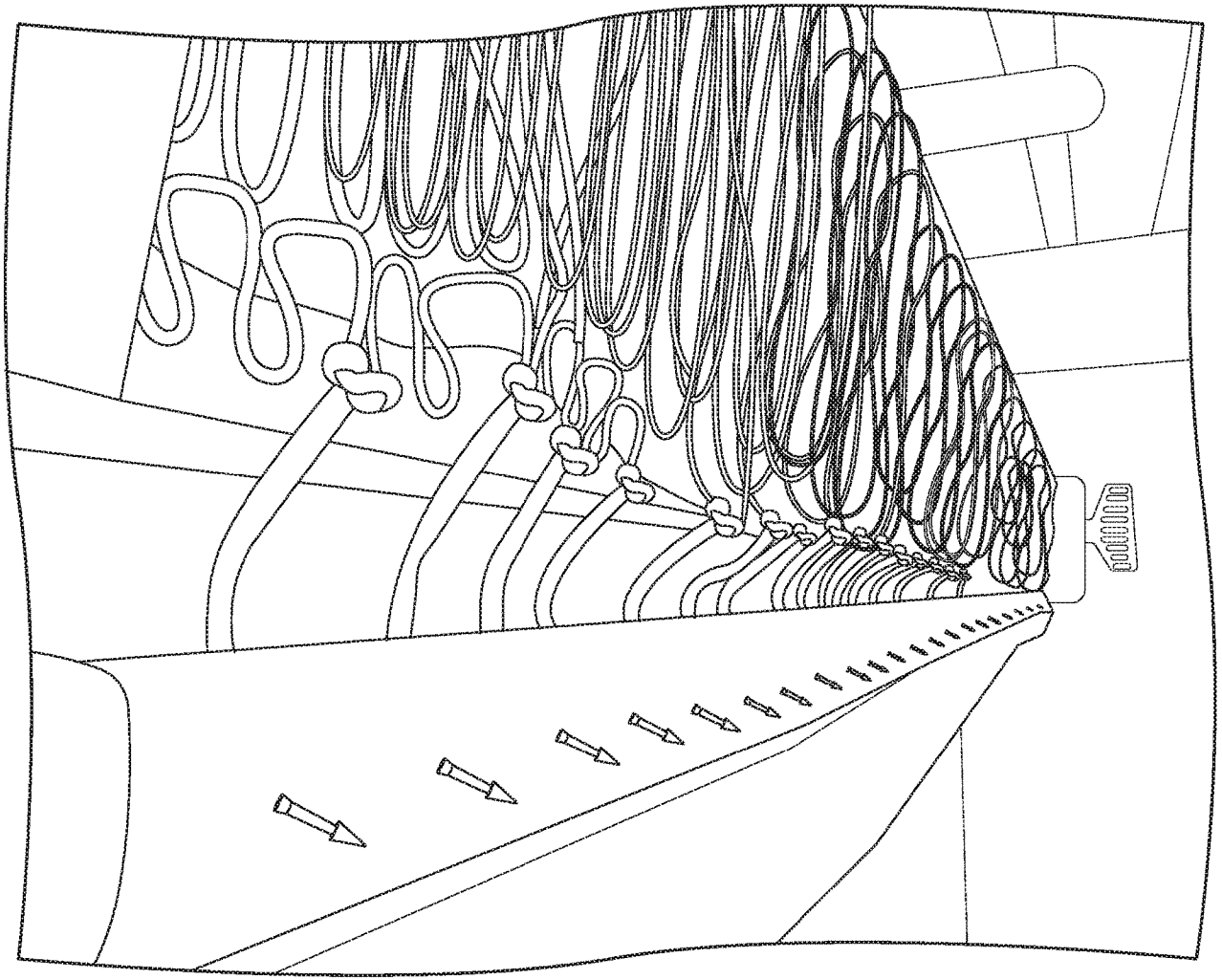
FIGS. 7B and 7C illustrate an alternative netting package utilizing a different arrangement of spike holders coupled with foam padding.
Figure 7C:
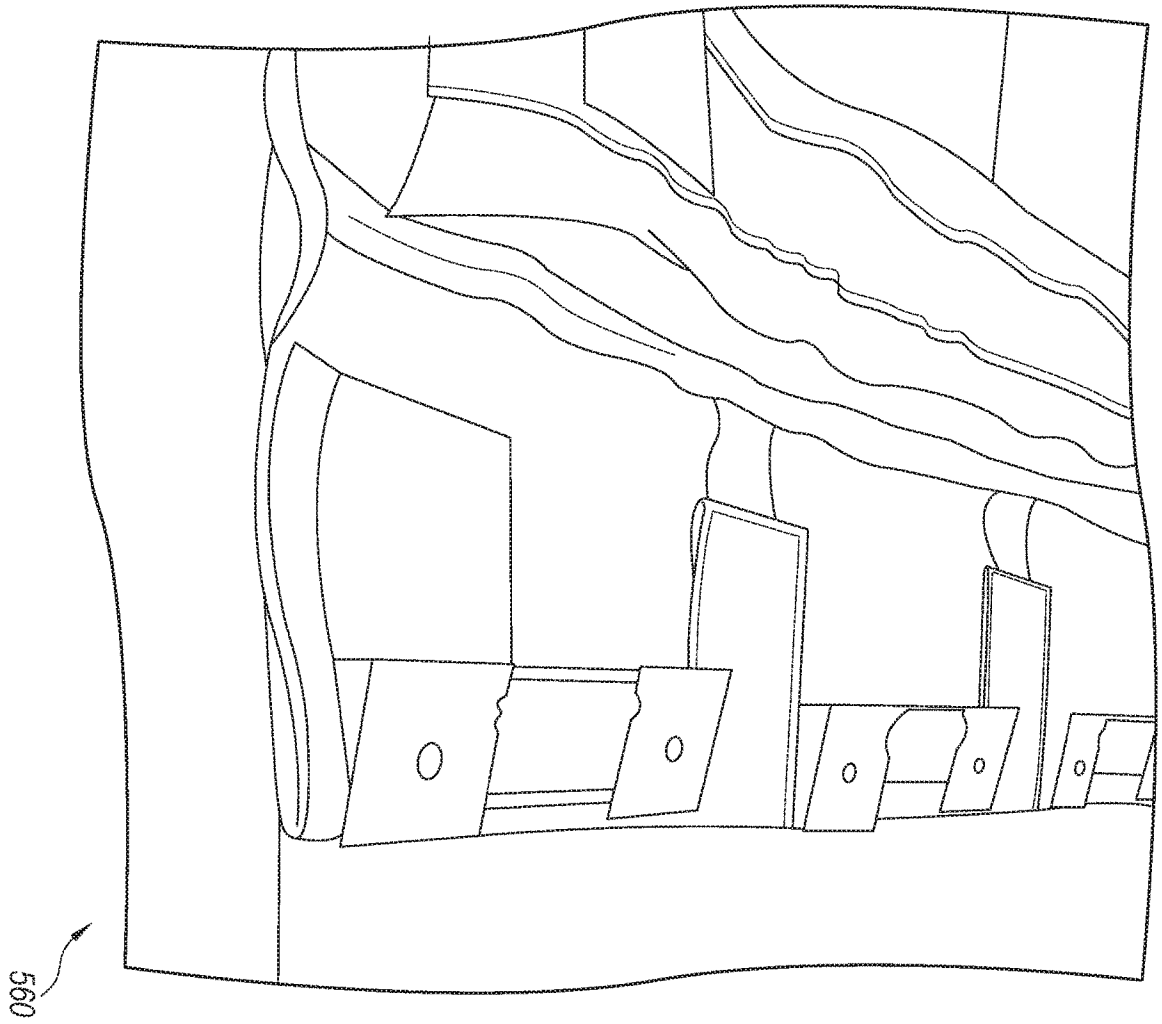

FIGS. 7B and 7C illustrate a netting assembly according to an alternative embodiment that utilizes a different spike holder and foam padding to keep spikes 560 in place. FIG. 7C illustrates the spike holder of the alternative embodiment with the spike and foam padding removed. The spikes are fitted into the holes of the holder which is affixed to the base layer 400.

Figure 8:
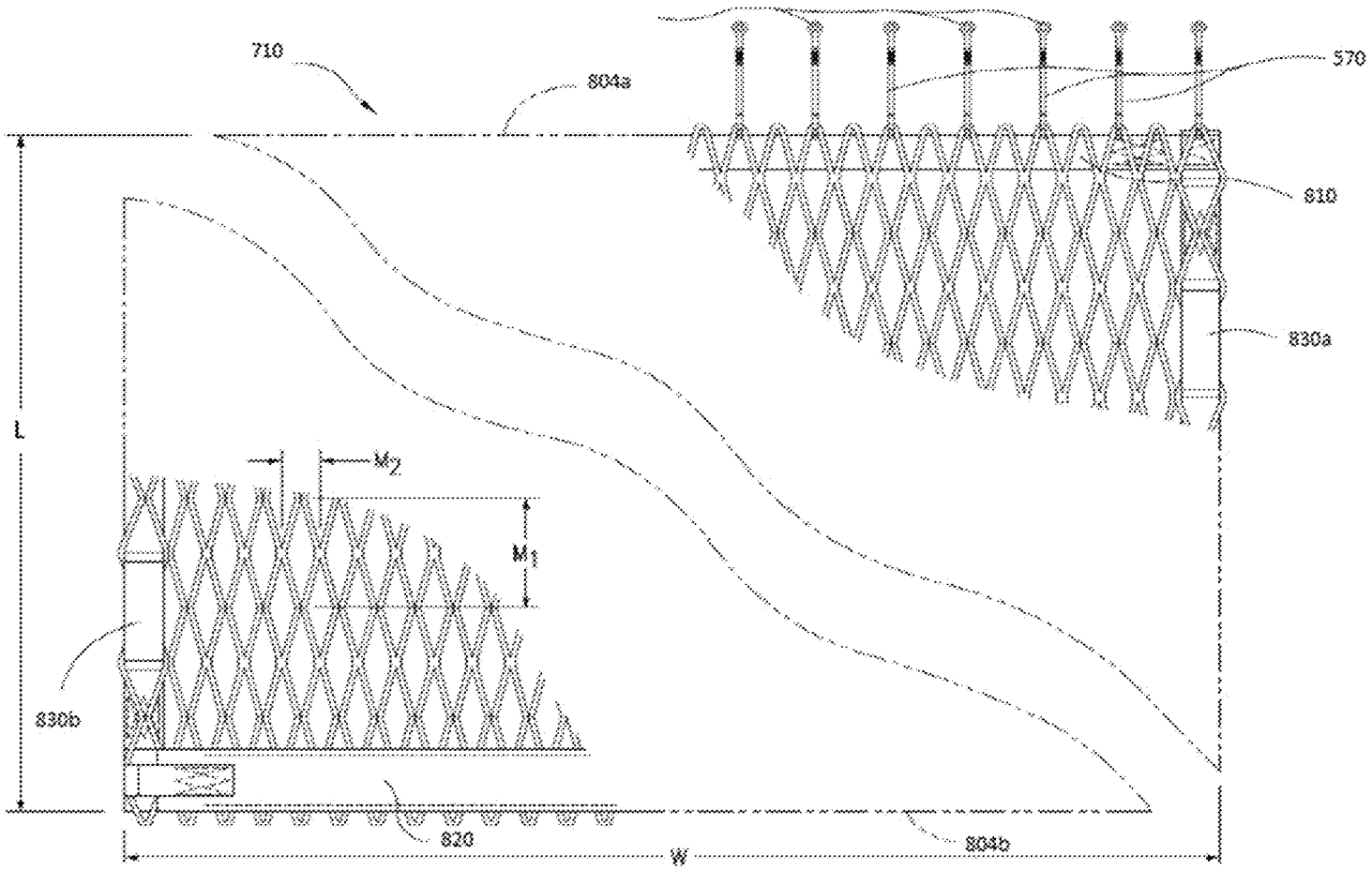
FIG. 8 is a partial view of an embodiment of example netting that may be utilized in an embodiment of the present disclosure.

FIG. 8 is a partial plan view showing portions of opposite corners of an embodiment of the netting 710 or "membrane" in an extended, unfolded configuration. The netting 710 can be comprised of, for example, a Dyneema® or other ultra-high molecular weight Polyethylene mesh net with sufficiently high tensile strength, having a width W preferably suitable for encompassing the track of the tires or wheels of a target vehicle and a length L preferably suitable for extending at least approximately 1.25 times around the circumference of the tires of the target vehicle. For example, if the target vehicle has a track of approximately 65 inches and rides on tires having an outer diameter of approximately 28 inches, the net 700 may have a width W of approximately 190 inches and a length L of at least approximately 110 inches. The dimensions the net 710 may be selected in part based upon the width of the roadway and also the circumference of the tire or wheel of the type of vehicle that is desired to be restrained by the device. A preferable minimum length of the net 710 in the example may be selected by computing 1.25 times the circumference of the wheel.

The netting 710 can have meshes that, in the stowed, rolled and/or coiled arrangement of the net, have an approximately diamond shape with a major axis M1 between distal opposite points approximately three to four times greater than a minor axis M2 between proximal opposite points. For example, the size of individual meshes in the widthwise direction may be approximately one inch in the stowed configuration, of the net 710, and the size of individual meshes in the lengthwise direction may be approximately 3.5 inches in the contracted arrangement of the net. Certain other embodiments according to the present invention may have approximately square shaped meshes.

The netting 710 may be assembled according to known techniques such as using "Weavers Knots" and/or a "Fisherman's Knot" to join lengths of cord and form the mesh. Certain embodiments according to the present disclosure may include coating the net material with an acrylic dilution, e.g., one part acrylic to 20 parts water, to aid in setting the knots and prevent them from slipping or coming undone.

It may be desirable to provide a widthwise stretch ratio of approximately 3:1. Accordingly, each mesh is reshaped or stretches in the widthwise direction, e.g., parallel to the wheel or tire track of the target vehicle, to a dimension approximately three times greater than its initial dimension. For example, a net having a 1.75 inch by 1.75 inch mesh size (unstretched) may be approximately 3.75 inches measured on the bias (stretched) when the net is entangled around the wheels or tires of a target vehicle in the fully deployed configuration of the device 100. According to this example, approximately 65 inches of the contracted net that is captured by the tire track of the target vehicle is expanded to approximately 245 inches that may become entangled on features of the undercarriage of the target vehicle approximately within its tire track.

The netting may also include a first strip 810 along a leading edge 804*a* of the net 710, a second strip 820 along a trailing edge 804*b* of the net 710, and/or lateral strips 830 (individual lateral strips 830*a* and 830*b* are shown in FIG. 8) extending between the leading and trailing edges. The first strip 810 may include, for example, approximately one inch wide nylon webbing that is sewn to the net with rip-stitching. Accordingly, the style and/or material of the stitching securing the first strip 810 to the net 710 allows the first strip 810 to at least partially detach from the net 710 in response to the tires of the target vehicle extracting the net 710 from the device 100 (e.g., the base layer 400). The second strip 820 includes a single strip extending approximately the entire width of the net 710. The second strip 820 may include, for example, approximately two inch wide nylon webbing that is securely sewn to the net 710 such that the second strip 820 remains at least approximately secured to the net 710 in response to the tires of the target vehicle extracting the net 710 from the device. Individual lateral strips 830 may include single strips intertwined with the meshes of the net 710 between the first and second strips 810 and 820. The lengthwise strips 830 may be securely coupled to the first and second strips 810 and 820 such that the lengthwise strips 830 remain at least approximately secured to the first and second strips 810 and 820 in response to the tires of the target vehicle extracting the net 710 from the device 100.

The first, second and/or lateral strips 810, 820 and 830 may maintain the approximate size and approximate shape of the net 710 in its contracted configuration, e.g., in a stowed configuration of the device. The second strip 820 that is secured to the trailing edge 804*b* of the net 710 may aid in cinching the net onto the wheels of the target vehicle so as to seize rotation of the entangled wheel(s) and thereby immobilize the target vehicle. The lateral strips 830 also may aid in cinching the netting onto the wheels or tires of the target vehicle and/or minimize net flaring as the net 100 wraps around the wheels or tires of the target vehicle.

Figure 9A:
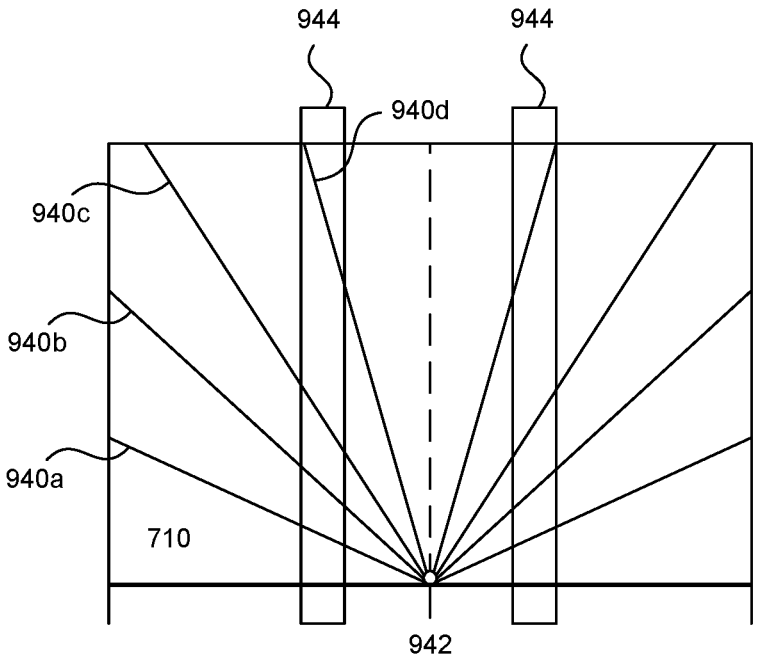
FIGS. 9A-9F are perspective and partial close-up views of example netting that may be utilized in an embodiment of the present disclosure.
Figure 9B:
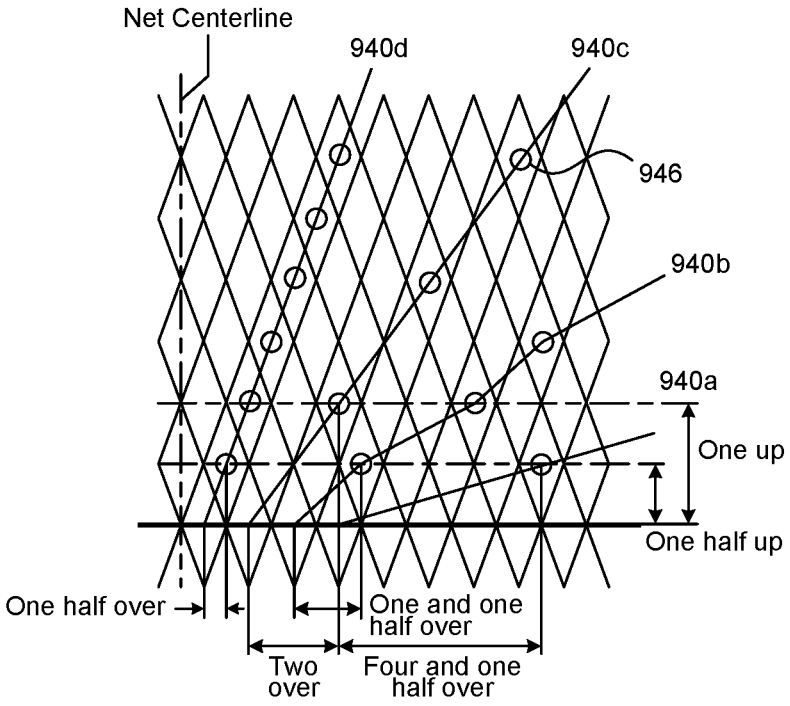

Additionally, as illustrated in FIGS. 9A-9D, the netting 710 can include one or more reinforcing strips 940, e.g., webbing, extending at various slopes from a common origin or center point 942 on the netting 710 and/or central axis of the netting. The reinforcing strips 940 can extend outward in both direction from the common center point 942. The reinforcing strips 940 can be intertwined or interwoven through the meshes to form various sloped or angled weave patterns within the netting 100 (as indicated by circled portions 946 in FIG. 9A showing transitions of the reinforcing strips 940 through the mesh. For example, FIGS. 9A-9B illustrates a top view and a partial close-up view of a netting 710 having the reinforcing strips 940 interweaved into the netting 710. An example tire track 944 illustrates how a weave pattern of reinforcing strips 940 extending from a common center point between the tire track 944 in FIGS. 9A and 9C.

Figure 9C:
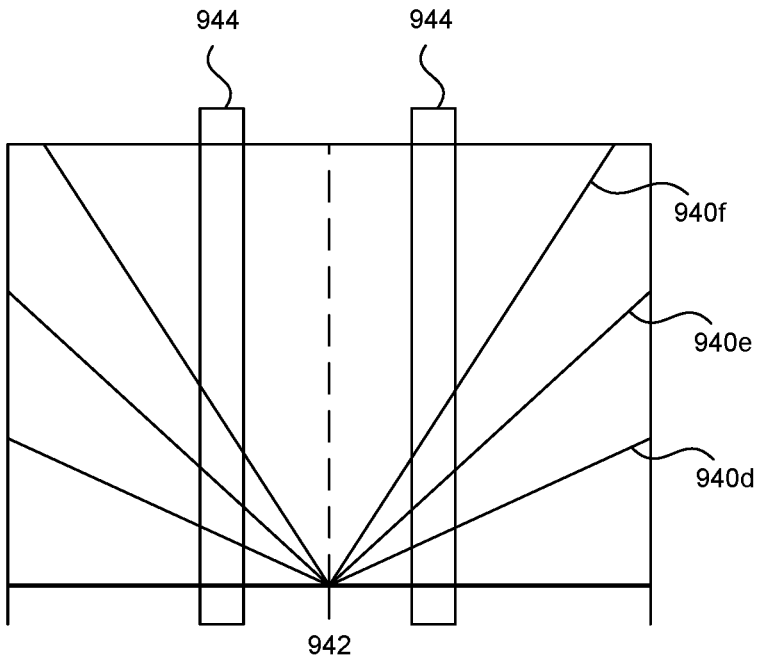
Figure 9D:
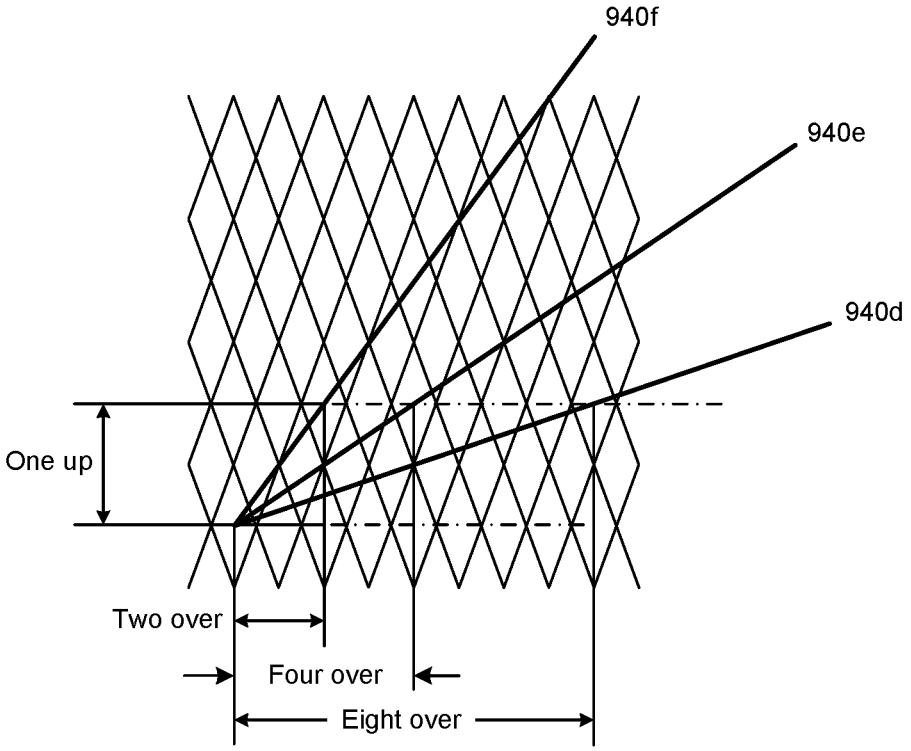

FIG. 9B illustrates a partial close-up view of the different sloped reinforcing strips 940 (identified individually as reinforcing strips 940*a*-940*d*) in FIG. 9A. The slopes of the reinforcing strips 940*a*-940*d* vary. For example, reinforcing strip 940*a* extends at a slope of four and one half over along the M2 axis and one half up along the M1 axis of the netting 710. Reinforcing strip 940*b* extends at a slope of one and one half over along the M2 axis and one half up along the M1 axis. Reinforcing strip 940*c* extends at a slope of two over along the M2 axis and one up along the M1 axis. Reinforcing strips 940*d* extends at a slope of one half over along the M2 axis and one half up along the M1 axis. As illustrated in FIG. 9B, with respect to strip 940*b*, some of the reinforcing strips may extend in a non-linear fashion (with varying slopes) due to the elasticity of the strips and/or the netting 710 and how they are interweaved in the netting 710. As illustrated in FIGS. 9C-9D, the netting may have more or less reinforcing strips 940 (e.g., identified individually as reinforcing strips 940*d*-940*f*) as necessary that extend at different or varying slopes. The netting 710 may include 1, 2, 3, 4, 5, 6, 7, 8, 9, 10 and/or more reinforcing strips 940. In some embodiments, each reinforcing strip can have a slope that is twice the slope of the strip preceding it (e.g., eight over and one up, four over and one up, two over and one up). Such reinforcing strips 940 helps the netting 710 ensnare and wrap around the tires of a vehicle to immobilize or restrict its motion.

Figure 9E:
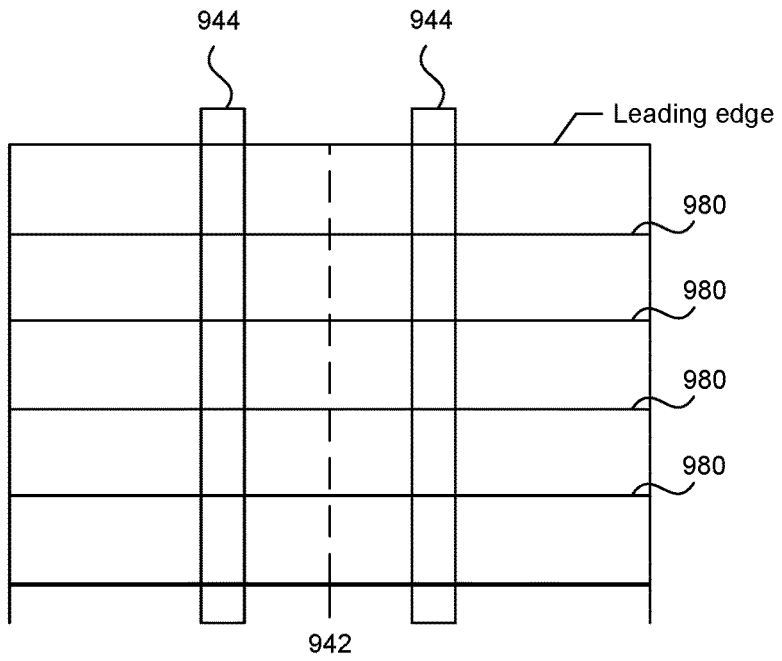

FIG. 9E illustrates the net 710 having multiple rip-stitched straps 980 (e.g., net tensioning straps that are positioned throughout the length of the net 710. These straps are configured to detach from the net 710 during the capture (e.g., ensnaring of the tires or vehicles). As the tires stretch the net 710 the rip-stitching straps 980 provide a resistance (e.g., tensioning) force that causes the net 710 to wrap tightly around the vehicle tires.

Figure 9F:
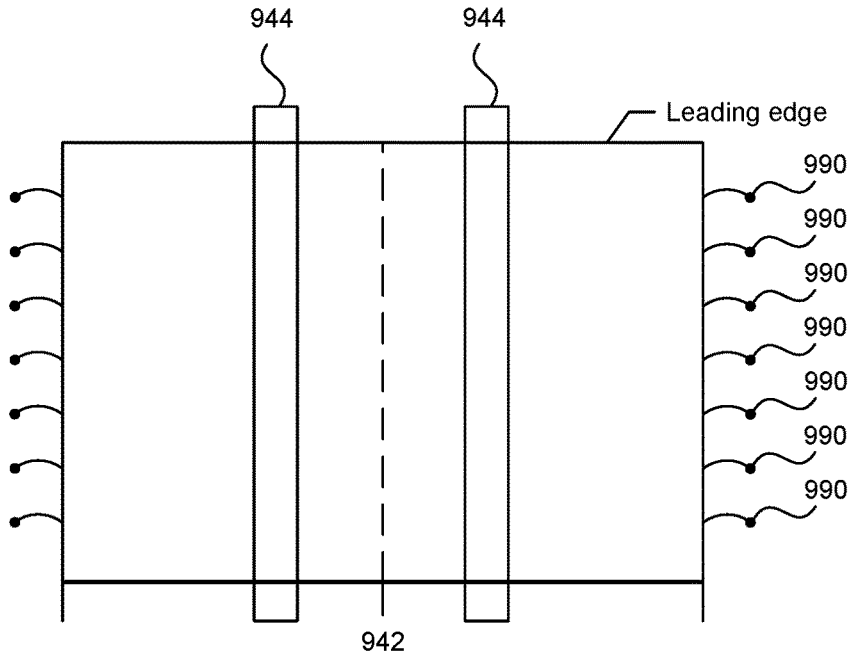

FIG. 9F illustrates the net 710 as described above having a plurality of weights 990 that are tethered or otherwise secured to the side edges or ends of the net 710. The weights 990 are used as "slingers" or "slinger weights" that can transfer the momentum of the net's removal from the carrier or base layer 400 to aid in wrapping the net 710 on the outside of the vehicle (e.g., tires or wheels) being captured. The weights 990 can be implemented on any of the net configurations described herein.

Embodiments of the device 100 according to the present disclosure are generally lightweight to allow the netting 710 to be deployed in, for example, 2 seconds or less. Being able to deploy the device faster allows a user to deploy the device later to reduce the ability of an oncoming drive to see the deployed netting 710 across a roadway or other surface. The continuous base fabric layer 400 (e.g., being able to be rolled into a roll), foam covers, plastic spike holders and/or Velcro fasteners help reduce or decrease the weight of the device 100. The lightweight aspect also allows such a device 100 to be portable and/or to be carried by a single person or two people.

Further, the reinforcing strips 940 strengthen the netting 710 and its ability to ensnare and wrap around a vehicle's tires. Therefore, the netting 710 can arrest or immobilize faster moving and heavier vehicles. For example, according to certain embodiments of the present disclosure, the device 100 can arrest a 60001*b* vehicle traveling at 60 mph in less than 100 m after the vehicle contacts the device 100.

Additional Embodiments

Figure 10:
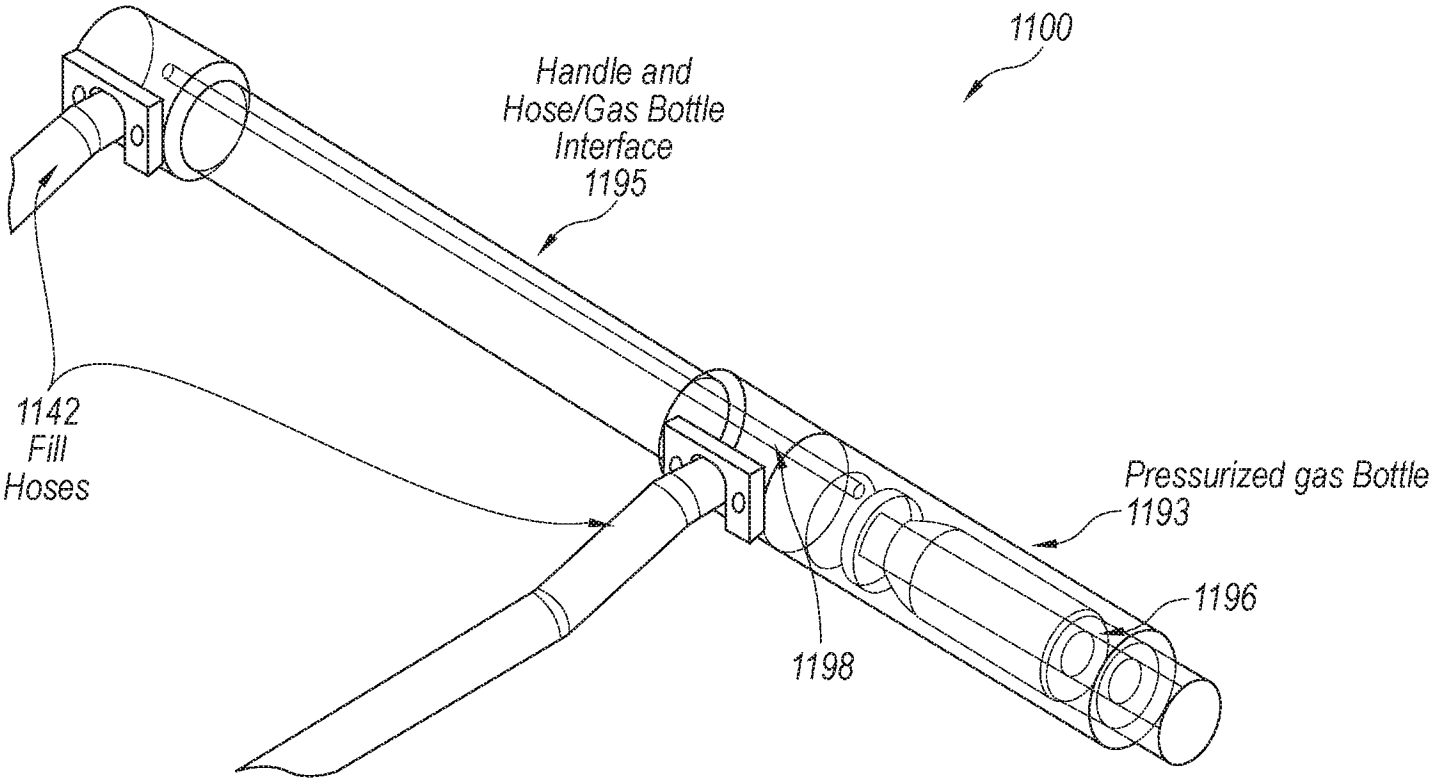
FIGS. 10-12 are perspective views with portions that are transparent or exploded, showing an example device that may be utilized with another embodiment of the present disclosure.
Figure 11:
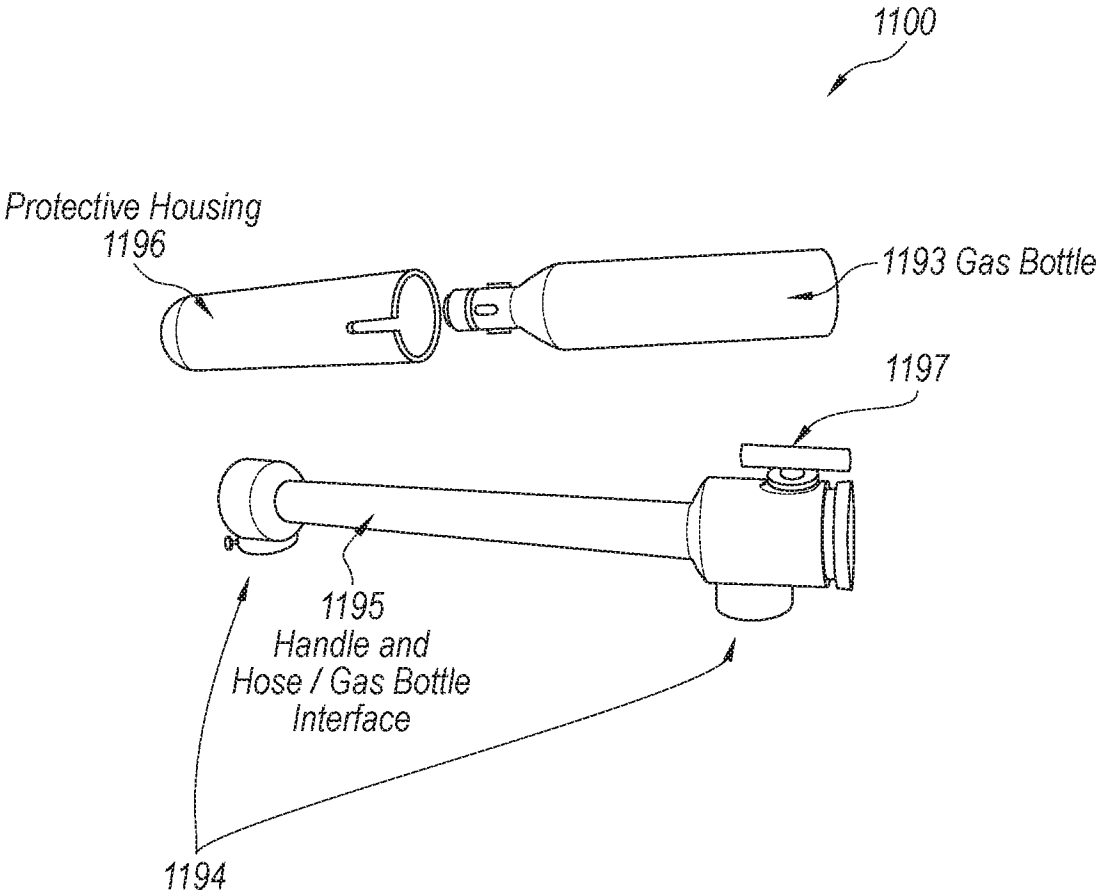
Figure 12:
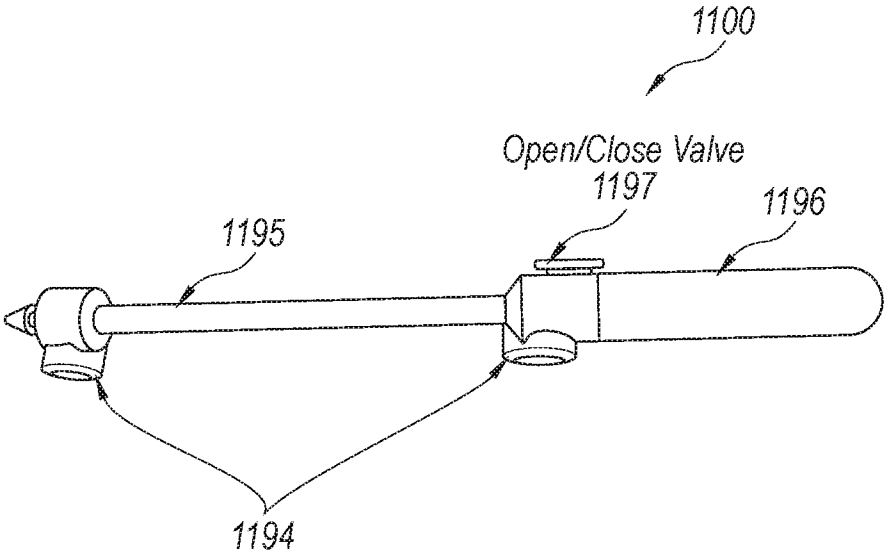

FIGS. 10-12 illustrate various views of a device 1100 for affecting movement of a land vehicle in accordance with yet another embodiment of the present technology. The device 1100 can include one or more features, in whole or in part, as described above with respect to devices. For example, the device 1100 can include a netting package (not shown) and associated components including a netting and one or more bladders, and/or other related components. However, the device 1100 includes additional, modified, or different features from device 100. In particular, the device 1100 is configured to be a handheld device having a "stand-alone" (e.g., independent or without a housing) netting package and handle 1195 wherein the netting package can be manually deployed (e.g., unrolled manually) across a road or other pathway. Such a design is expected to provide a lightweight, portable, and easily transportable device capable of affecting vehicle movement. The device 1100 provides a method for holding (e.g., a handle as described below) the netting or netting package while being rolled manually.

Referring to FIGS. 10-12 together, the device 1100 includes a main body portion or handle 1195 (e.g., a tube, conduit, etc.) that is removably attachable to a netting package (not shown) via one or more bladders 1142 (e.g., hoses). As described above, the one or more bladders 1142 can be inflated or pressurized via gas from a gas bottle 1193. The gas bottle 1193 can be coupled to the handle 1195 and in fluid communication with the bladders 1142. The device 1100 can include quick disconnect features 1194 (e.g., as described above) for removably coupling the bladders 1142 to the handle 1195. The device 1100 can include a separate protective housing 1196 for the gas bottle 1193 that can be removably coupled to the handle 1195. The handle 1195 can include a valve 1197 for releasing gas and pressurizing the bladders when the gas bottle and/or protective housing are coupled to the handle. In other embodiments, the protective housing 1196 and/or the gas bottle 1193 can be integrated directly with the handle 1195 in a unitary or monolithic configuration.

In use, for example, a netting package can be secured to the handle 1195 via the one or more bladders 1142 while a user manually unrolls or unfurls a net of the netting package across a road or other pathway. The bladders 1142 can then be pressurized by opening the valve 1197 to release gas from the gas bottle 1193 into the bladders 1142 via one or more conduits 1198 (e.g., tubes, hoses, etc.) extending through the handle 1195. The pressurized bladders 1142 provide rigidity and stability for the netting package. For example, the pressurized bladders can stabilize spikes of the netting package and maintain a position of the netting package across the road to allow substantial or full and effective penetration of vehicle tires as the vehicle crosses the netting package. As described in more detail above with respect to the netting package 30, the hoses or bladders can be located along aft and forward edges of the netting package or netting. When inflated, they provide rigidity/stability to the system which includes the spike holders of the netting package. This stability helps prevent the spikes from moving from a preferred or specified orientation when the tires contact the netting package. Maintaining the spikes at a specified angle/orientation allows the spikes to penetrate the tires more effectively.

The above detailed description of embodiments is not intended to be exhaustive or to limit the invention to the precise form disclosed above. Also, well-known structures and functions have not been shown or described in detail to avoid unnecessarily obscuring the description of the embodiments of the present disclosure. While specific embodiments of, and examples for, the invention are described above for illustrative purposes, various equivalent modifications are possible within the scope of the invention, as those skilled in the relevant art will recognize. As an example, certain embodiments of devices according to the present disclosure may include a pressure generator disposed in a device control housing with other operating elements, such as, but not limited to, a pressure delivery manifold, control circuitry to arm and deploy, a proximity detector, a signal receiving and sending circuit and any other hardware, software or firmware necessary or helpful in the operation of the device. As another example, the device may be housed in a clamshell-type briefcase or ammunition box type housing and include a pressure manifold and a pressure-generating device, such as compressed gas or a gas generator connected to the manifold. In other embodiments more than one manifold and more than one pressure generating device, or any combination thereof, may be included in the device.

Unless the context clearly requires otherwise, throughout the description and the claims, the words "comprise", "comprising", and the like are to be construed in an inclusive sense, as opposed to an exclusive or exhaustive sense; that is to say, in the sense of including, but not limited to. Additionally, the words "herein", "above", "below", and words of similar connotation, when used in the present disclosure, shall refer to the present disclosure as a whole and not to any particular portions of the present disclosure. Where the context permits, words in the above Detailed Description using the singular or plural number may also include the plural or singular number respectively. The word "or", in reference to a list of two or more items, covers all of the following interpretations of the word: any of the items in the list, all of the items in the list, and any combination of the items in the list.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

We claim:

1. A deployable apparatus for immobilizing a land vehicle, positioned at the side of a roadway when in an undeployed state, comprising:

a netting package including a base layer comprising a plurality of receptacles to which a plurality of penetrators are removably attached; and a deployment module including a movable back plate, the deployment module configured to push on the base layer using the movable back plate so as to cause the base layer to unroll and lay across the roadway upon deployment, wherein, upon deployment, the penetrators are arranged on the roadway such that at least one penetrator will puncture and become lodged in a tire of an oncoming land vehicle.

2. The apparatus of claim 1, further comprising netting tethered to the penetrators, wherein, when at least one penetrator punctures a tire during deployment, the penetrator pulls the netting to ensnare the tire.

3. The apparatus of claim 1, further comprising at least one deployment hose attached to the base layer and an inflator in the deployment module.

4. The apparatus of claim 3, wherein the deployment hose is configured to be in a rolled configuration when the base layer is in a stowed configuration, and wherein inflation of the deployment hose causes the base layer to unroll and lay across the roadway upon deployment.

5. The apparatus of claim 1, wherein the receptacles hold the penetrators at a predetermined angle.

6. The apparatus of claim 1, wherein the plurality of penetrators are spikes.

7. The apparatus of claim 6, further comprising spike tethers connecting spikes to netting.

8. The apparatus of claim 6, wherein the spikes are positioned in the base layer to point toward a center of the base layer when in a rolled configuration.

9. The apparatus of claim 1, further comprising two deployment hoses, each attached at opposing sides of the base layer.

10. The deployable apparatus of claim 1, wherein the deployment module causes the base layer to unroll unidirectionally.

11. The deployable apparatus of claim 1, wherein the deployment module provides an initial acceleration of the netting package onto the roadway upon deployment.

12. The deployable apparatus of claim 1, wherein the back plate assists in holding the netting package while in the undeployed state.

* * * * *